US005952965A

United States Patent [19]

Kowalski

[11] Patent Number: 5,952,965

[45] Date of Patent: Sep. 14, 1999

[54] ADAPTIVE MAIN BEAM NULLING USING ARRAY ANTENNA AUXILIARY PATTERNS

[75] Inventor: Anthony M. Kowalski, Miller Place, N.Y.

[73] Assignee: Marconi Aerospace Systems Inc. Advanced Systems Division, Greenlawn, N.Y.

[21] Appl. No.: 09/121,077

[22] Filed: Jul. 21, 1998

[51] Int. Cl.[6] ..... H01Q 3/24

[52] U.S. Cl. ..... 342/372; 342/373; 342/380; 342/381

[58] Field of Search ..... 342/380, 381, 342/383, 384, 372, 373

[56] References Cited

U.S. PATENT DOCUMENTS

| | | | |
|---|---|---|---|
| 4,170,775 | 10/1979 | Masak et al. | 343/100 LE |
| 4,720,712 | 1/1988 | Brookner et al. | 342/383 |
| 5,028,931 | 7/1991 | Ward | 342/383 |
| 5,276,452 | 1/1994 | Schuss et al. | 342/371 |
| 5,579,016 | 11/1996 | Wolcott et al. | 342/378 |
| 5,600,326 | 2/1997 | Yu et al. | 342/17 |
| 5,771,017 | 6/1998 | Dean et al. | 342/374 |

*Primary Examiner*—Thomas H. Tarcza
*Assistant Examiner*—Dao L. Pham
*Attorney, Agent, or Firm*—Edward A. Onders; Kenneth P. Robinson

[57] ABSTRACT

Without use of separate auxiliary antennas, adaptive nulling automatically reduces jamming or other interference affecting a radar or IFF system. A primary beam forming network utilizes four-port directional coupler devices, each having an ancillary port which would have been resistively terminated in the absence of the invention. Signals from ancillary ports are coupled to an auxiliary beam forming network to form auxiliary beam patterns which are orthogonal to and track steered main beam patterns. Auxiliary signals are received via the auxiliary beam patterns. Least mean square (LMS) control loops operate on a feedback basis to derive weighted auxiliary signals responsive to jamming signals. The weighted auxiliary signals are combined with the primary received signals (which may be sum and difference signals) in reverse polarity, so as to be additively destructive of the jamming signals. Multiple LMS control loops enable nulling of jamming signals simultaneously in sum and difference channels. Multiple control loops may be implemented on a time share or multiplexed basis.

27 Claims, 19 Drawing Sheets

ADAPTIVE MAIN BEAM NULLING USING ARRAY ANTENNA AUXILIARY PATTERNS

RELATED APPLICATIONS (Not Applicable)

FEDERALLY SPONSORED RESEARCH (Not Applicable)

BACKGROUND OF THE INVENTION

This invention relates to reduction of jamming or other interference affecting signal reception and, more particularly, to use of auxiliary beam patterns of an array antenna to provide interference reduction by adaptive main beam nulling, with application to sum and difference pattern processing and to IFF applications.

In operation of radar and identification friend-or-foe (IFF) systems, reception of desired signals may be degraded or obscured by the presence of a variety of forms of jamming signals or other types of intentional and unintentional interfering signals. Many techniques have previously been described for enabling or improving reception of desired signals in the presence of interfering signals, particularly in the context of systems utilizing directional receiving antenna configurations. Such prior techniques typically address sidelobe, rather than main lobe, signal cancellation and may require provision of one or more auxiliary omnidirectional antennas to provide auxiliary signals useful for cancellation processing. Representative prior systems are shown in U.S. Pat. Nos. 3,202,990, 3,881,177, 3,982,245 and 4,044,359.

While early systems may have required adjustments to address particular jamming signals, other systems have employed automated or adaptive nulling techniques to cause a sidelobe null to be effective in the direction from which jamming signals arrive at a receiving antenna. Certain of these systems have employed adaptive feedback loops using complex weighting devices, responsive to least mean square (LMS) processing of an auxiliary signal containing a jamming signal, to develop a weighted signal which, when combined with the received signal, is effective to tend to minimize the presence of the jamming signal in a sidelobe of the received signal. See, for example, U.S. Pat. Nos. 4,280,128 and 4,584,583.

So far as is known, however, there have not previously been provided effective systems for achieving automated cancellation of jamming signals from the main beam of a received signal, and such systems effective in application (a) to systems utilizing sum and difference signal processing, (b) to IFF systems necessitating anti-jam implementation with a minimum of additional circuit elements, (c) to provide simultaneous multi-jammer cancellation, and (d) to combinations of the foregoing.

Objects of the present invention are, therefore, to provide new and improved anti-jam systems and such systems providing one or more of the following capabilities and characteristics:

- main beam adaptive nulling, in addition to sidelobe adaptive nulling;
- operation without requiring separate auxiliary antennas;
- provision of auxiliary beam patterns by use of ancillary signals normally dissipated in main beam formation;
- provision of orthogonal auxiliary beam patterns which track main beam steering;
- provision of auxiliary signals from beams formed by an auxiliary beam forming network;

- simultaneous nulling for both sum and difference beam patterns;
- simultaneous adaptive nulling of a plurality of jammers (e.g., four jammers) by parallel LMS control loops;
- nulling of higher average power continuous wave or other interference, in contrast to lower average power pulsed IFF or radar signals;
- multiple LMS control loop functions implementable by use of time share or multiplexing techniques; and
- nulling system implementation suitable for IFF and other applications.

SUMMARY OF THE INVENTION

In accordance with the invention, an adaptive nulling system, usable with an array antenna, includes a primary beam forming network to couple signals to and from an array of radiating elements to produce a primary received signal via a primary beam pattern. This primary beam forming network has ancillary ports providing signals not used in producing the primary received signal. The system also includes an auxiliary beam forming network, responsive to signals from ancillary ports of the primary beam forming network, to produce auxiliary signals received via a number of auxiliary beams. A controller, responsive to the auxiliary signals and to an adapted received signal, provides control signals. A weighting unit is responsive to the control signals and the auxiliary signals to provide weighted auxiliary signals. A signal combiner, arranged to combine the weighted auxiliary signals with the primary received signal, provides an adapted received signal output which is also fed back for use by the controller.

The invention has particular application to a radar or IFF system in which the primary received signal is a pulsed signal of relatively low average power and an interfering signal is of relatively higher average power, such as a continuous wave jamming signal, for example. The controller is arranged to provide control signals responsive to the relatively higher average power jamming signal as present in the adapted received signal. The weighting unit provides a weighted auxiliary signal representing a replica of the jamming signal and the combiner is arranged to combine the weighted auxiliary signal in reverse polarity with the primary received signal. This results in an adapted received signal characterized by reduction in amplitude of the jamming signal.

Further in accordance with the invention, an adaptive nulling system arranged for use with both sum and difference signals includes an array of radiating elements and a primary beam forming network coupled to the radiating elements to produce a primary sum signal and a primary difference signal, via a primary beam pattern. The primary beam forming network has ancillary ports providing signals not used in producing the primary signals. The system also includes an auxiliary beam forming network, responsive to signals from the ancillary ports, to produce auxiliary signals received via a number of auxiliary beams. A controller, responsive to the auxiliary signals and to an adapted sum signal and an adapted difference signal, provides sum and difference control signals. A first weighting unit is responsive to the sum control signals and the auxiliary signals to provide weighted auxiliary signals, and a first signal combiner is arranged to combine the weighted auxiliary signals from the first weighting unit with the primary sum signal to provide the adapted sum signal as used in the controller. A second weighting unit is responsive to the difference control signals and the auxiliary signals to provide weighted auxiliary signals, and a second signal combiner is arranged to combine the weighted auxiliary signals from the second weighting unit with the primary received signal to provide the adapted difference signal as used in the controller.

For a better understanding of the invention, together with other and further objects, reference is made to the accompanying drawings and the scope of the invention will be pointed out in the accompanying claims.

DESCRIPTION OF THE INVENTION

Figure 1:
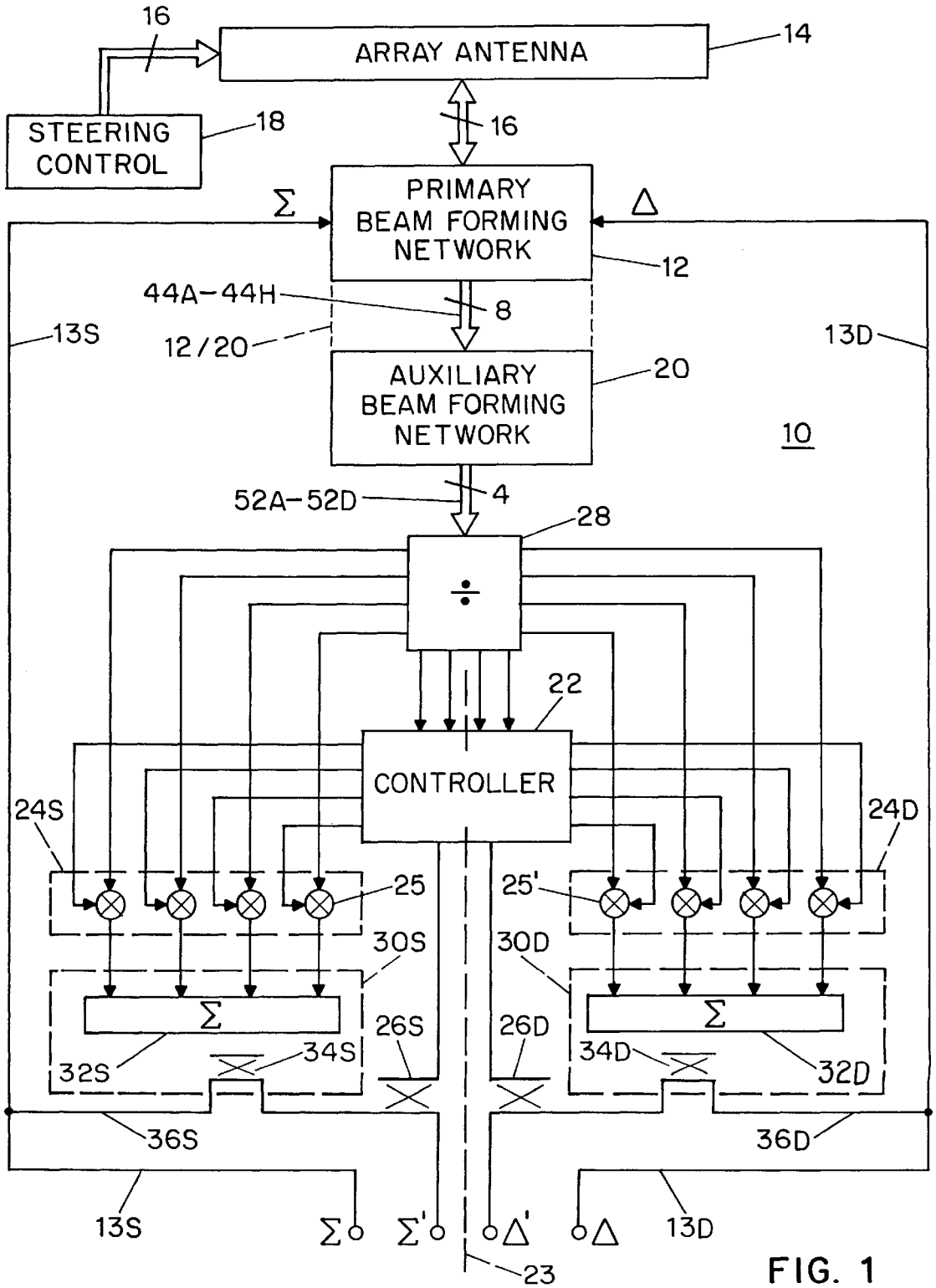
FIG. 1 is a simplified block diagram of a main beam adaptive nulling system in accordance with the invention.

An embodiment of a main beam nulling system 10 in accordance with the invention is illustrated in block diagram form in FIG. 1. As shown, the system includes a primary beam forming network 12 arranged to couple signals to and from an array of radiating elements, represented as array antenna 14. In the current example, antenna 14 includes a linear array of 16 radiating elements of suitable type and design, which may be arranged to enable provision for beam steering. Steering control unit 18, shown in block form, may provide 16 individual steering control signals to phase shifters in the signal paths of the respective radiating elements, for example. Steering unit 18 may thus control the relative phase of signals coupled to and from the radiating elements to steer the primary beam pattern in azimuth. Such beam steering may be implemented as appropriate by skilled persons using established techniques. Primary beam forming network 12 provides the basic function of providing signals of appropriate relative phase and amplitude for coupling to the 16 radiating elements during transmission in order to produce a primary beam pattern of radiated power (such phase being subject to adjustment for beam steering, as discussed).

On reception, network 12 is effective to produce a primary received signal, representing signals received via the primary beam pattern. As will be described, in a currently preferred embodiment primary received signals take the form of a primary sum signal (output from network 12 via signal path 13S) and a primary difference signal (output from network 12 via signal path 13D). Also, as will be described in greater detail, primary beam forming network 12 utilizes coupling devices having ancillary ports providing signals which are not used in producing the primary received signal (e.g., primary sum signal and primary difference signal) from signals incident at the 16 radiating elements.

The FIG. 1 adaptive nulling system also includes an auxiliary beamforming network 20, which is responsive to signals from selected ones of the ancillary ports existing within the primary beam forming network 12. As schematically represented in FIG. 1, in this example eight signal coupling paths are provided to couple signals from ancillary ports in network 12 for processing in auxiliary network 20. With eight input signals, auxiliary beam forming network 20 is configured (as will be addressed in greater detail) to produce four auxiliary signals. Utilizing beam forming techniques, network 20 is effective to provide each of the four auxiliary signals as a signal received via a different one of four auxiliary beams, each of which is represented by a beam pattern which is different than the primary beam pattern (e.g., different than the sum and difference patterns) produced pursuant to the basic beam forming function of network 12. Thus, the primary beam forming network 12 may provide sum and difference patterns as respectively illustrated in FIGS. 2 and 3. Concurrently, the secondary network 20 may provide four auxiliary beam patterns as respectively illustrated in FIGS. 4A through 4D. As a result of the beam forming processing, a characteristic of the four auxiliary beams is that they are all orthogonal to each other and each has a pattern null in the direction of the peak of the sum pattern.

As shown in FIG. 1, the system includes a controller 22, which is responsive to the four auxiliary signals provided by auxiliary beam forming network 20, and also responsive to an adapted received signal, in order to provide control signals to weighting units 24S and 24D. Units 22, 24S and 24D will be described in greater detail below. For sum signal processing, the adapted received signal is coupled to controller 22 by directional coupler 26S. Coupler 26S is positioned to access the sum signal (from signal path 36S) after it has been adapted by operation of the invention for nulling purposes as will be described. Thus, the "primary" sum signal as produced by the network 12 on path 13S has been modified to become the "adapted" sum signal, which is a principal output signal of the system at port Σ' and a sample of which is also fed back by coupler 26S. It is noted that with description of the invention in the sum and difference signal context, elements included to the left of dashed line 23 for sum mode operation are replicated to the right of line 23 for difference mode operation (e.g., in mirror image relationship). For simplicity of description, attention will be directed to elements located to the left of line 23, with the understanding that corresponding construction and operation of elements are provided on the other side of line 23. As shown in FIG. 1, there is also included a signal divider unit 28, which is arranged to provide three output portions for each of the four auxiliary signals available from auxiliary beam forming network 20. Thus, divider unit 28 provides a portion of each auxiliary signal to each of units 22, 24S and 24D.

The FIG. 1 system includes the respective sum and difference weighting units shown as first weighting unit 24S and second weighting unit 24D. Weighted output signals provided to first signal combiner 30S from first weighting unit 24S are combined with the primary received signal (in this case, the primary sum signal) provided from the primary beam forming network via signal path 13S. As illustrated, first signal combiner 30S includes a signal summing unit 32S and a directional coupler 34S arranged to couple combined weighted auxiliary signals into the adapted sum signal path 36S. Difference signal processing elements 24D, 26D, 30D 32D and 34D have construction and operation corresponding to the identically numbered elements shown to the left of dashed line 23, as already described. It will be appreciated that the system is illustrated in FIG. 1 in simplified form for purposes of description and does not include signal isolation elements as necessary to protect the adaptive processing system from power levels present during signal transmission. Appropriate circuit elements and configurations to meet that and other practical system considerations necessary in providing operational systems can be provided by skilled persons once having an understanding of the invention.

Figure 2:
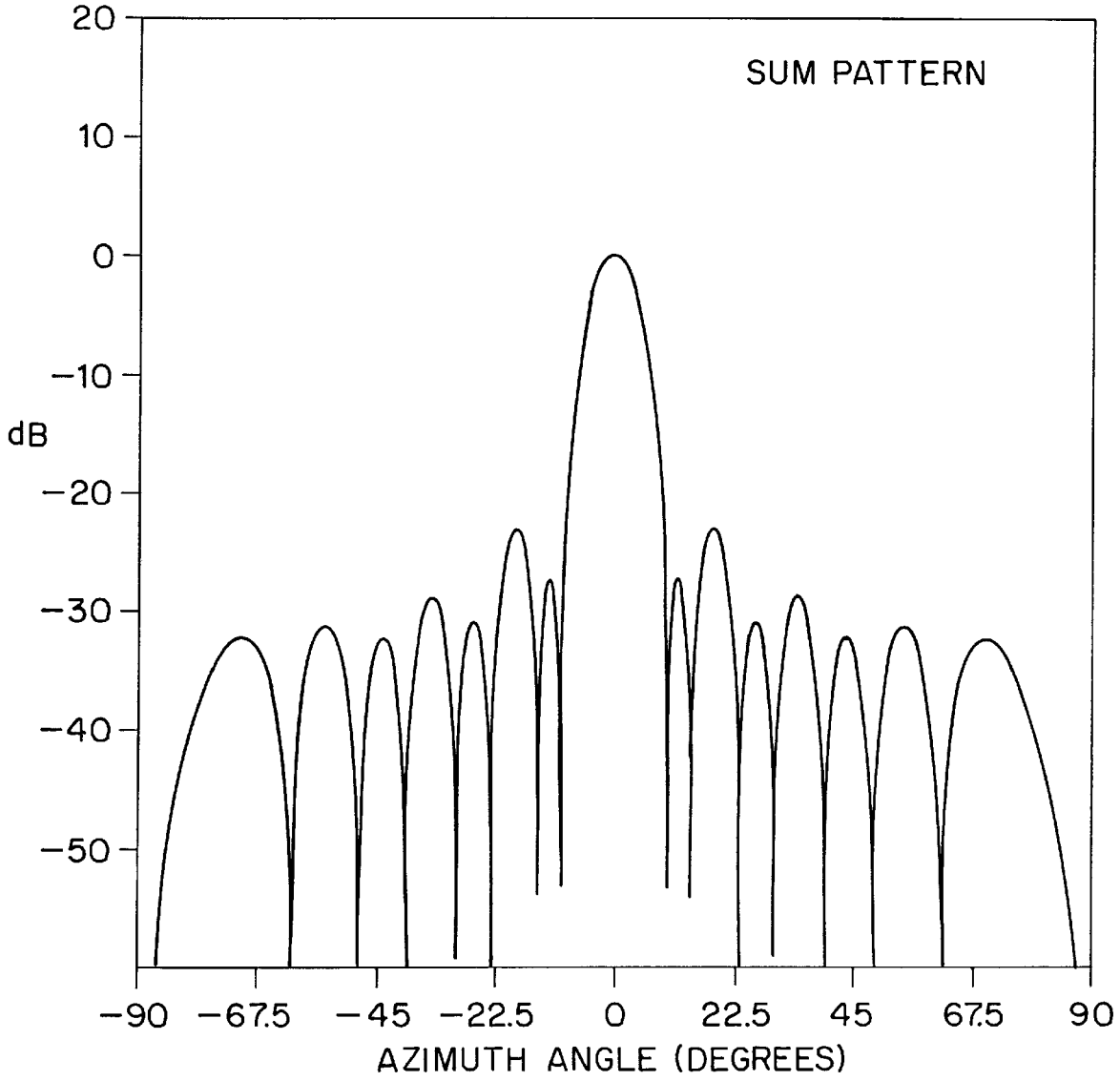
FIGS. 2 and 3 are respective primary beam patterns for sum and difference operation.
Figure 3:
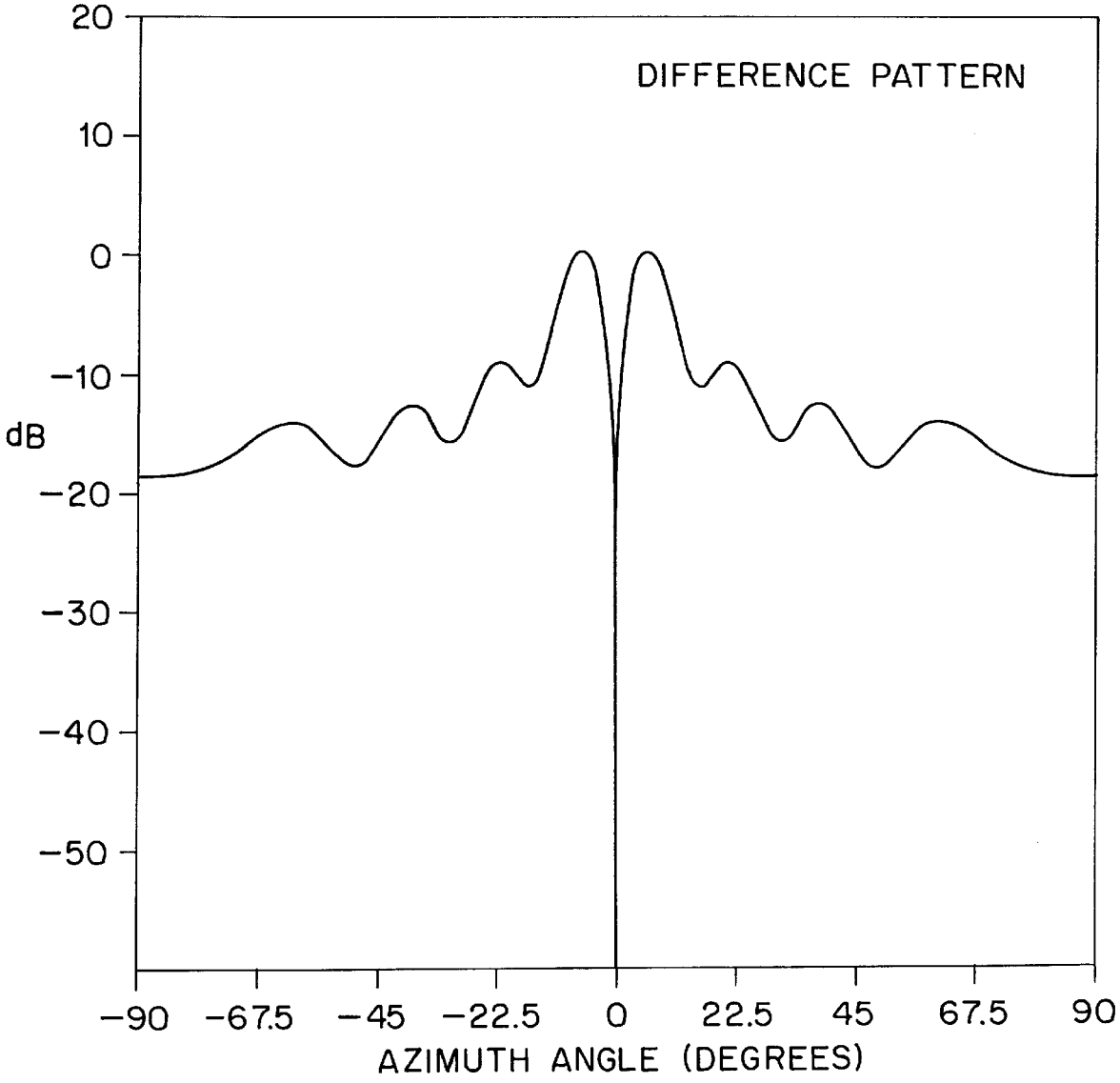
Figure 5A:
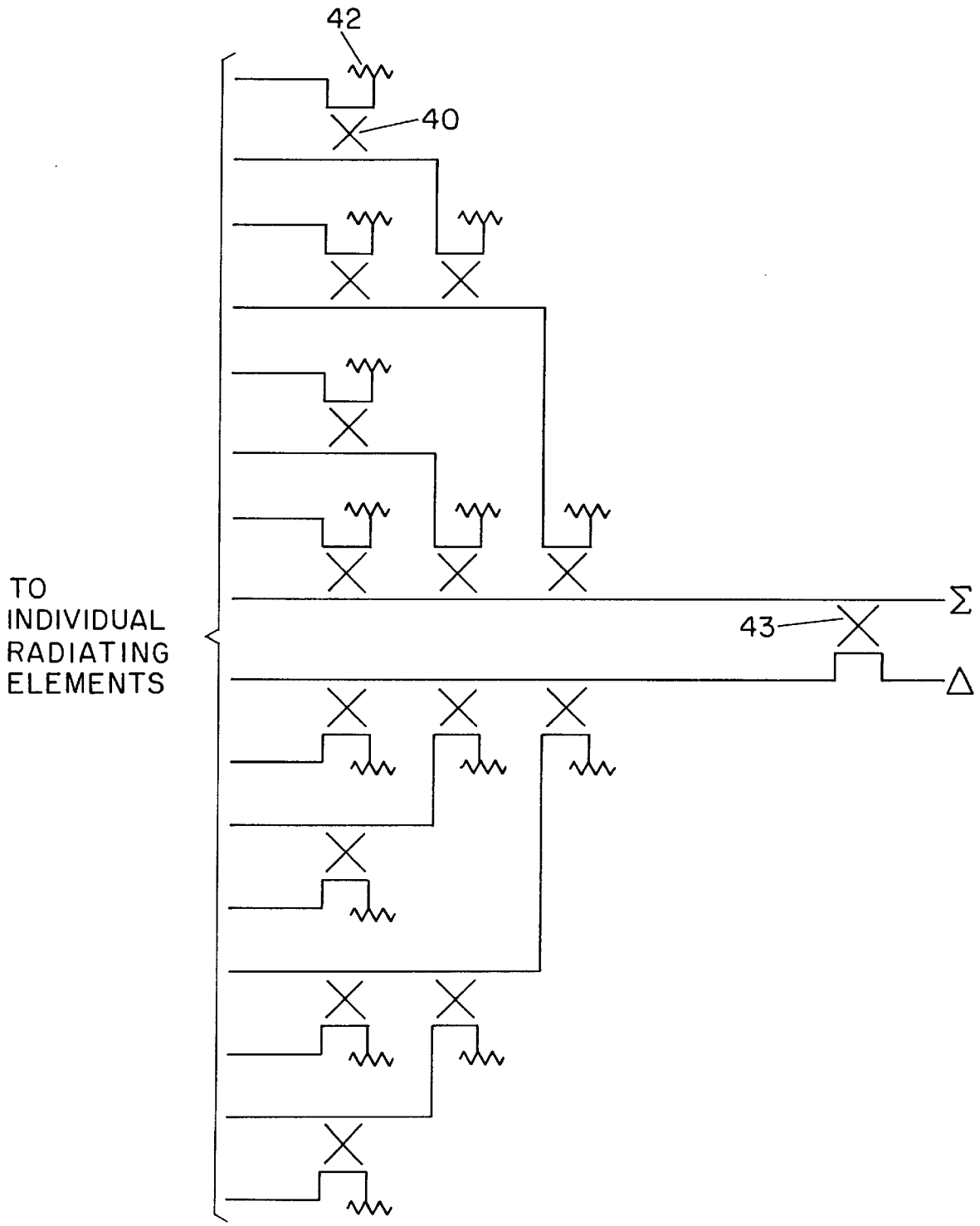
FIGS. 5A and 5B provide additional detail for the primary beam forming network of FIG. 1 prior to implementation of the invention and after modification pursuant to the invention, respectively.

With reference now to FIG. 5A, there is illustrated a form of beam forming network suitable for providing sum and difference beam patterns on transmission and reception in the absence of use of the invention. As shown, the network includes a configuration of 15 four-port directional couplers arranged to couple signals between sum and difference ports on the right and individual radiating elements of an array antenna which can be connected to the 16 signal paths ending at the left in FIG. 5A. The couplers may suitably be branchline type couplers configured for unequal signal split to provide signal amplitude distribution among the 16 radiating elements as appropriate to provide the desired radiation beam pattern profile on signal transmission. Fourteen of the directional couplers, of which coupler 40 is typical, each have one port resistively terminated and each has a coupling factor selected to collectively provide a desired excitation of the aperture of an associated linear array antenna. The fifteenth directional coupler 43 is arranged to combine signals from the left and right (lower and upper in FIG. 5A) halves of the array in in-phase and out-of-phase relationships to provide sum beam pattern and difference beam pattern accessibility at the respective sum (Σ) and (Δ) input/output ports. The specific design parameters for particular implementations can be determined by skilled persons using established techniques. FIG. 2 shows a representative sum beam pattern with peak level of 11.5 dB and sidelobes down 24 dB and FIG. 3 shows a corresponding difference beam pattern with peak level of 7.9 dB with no secondary nulls (in FIGS. 2 and 3 the gain at pattern peak is normalized to 0 dB for presentation). As will be appreciated, the actual pattern gain at beam peak is determined by multiplication of the FIG. 2 pattern, for example, by the pattern characteristics of the actual radiating elements employed. For the present discussion calculations are based on the use of omnidirectional elements (i.e., elements which provide unit effect).

With reference to FIG. 5A, it will be seen that in this configuration each of the fourteen directional couplers corresponding to coupler 40 is a four-port device. Of these, three ports of each coupler are actively used for sum and difference signal transmission and reception, with the signals appearing at the fourth port of each coupler resistively dissipated. For present purposes, such fourth port of each of such coupler is termed an "ancillary port", as it is not directly used for sum and difference signal purposes.

Figure 5B:
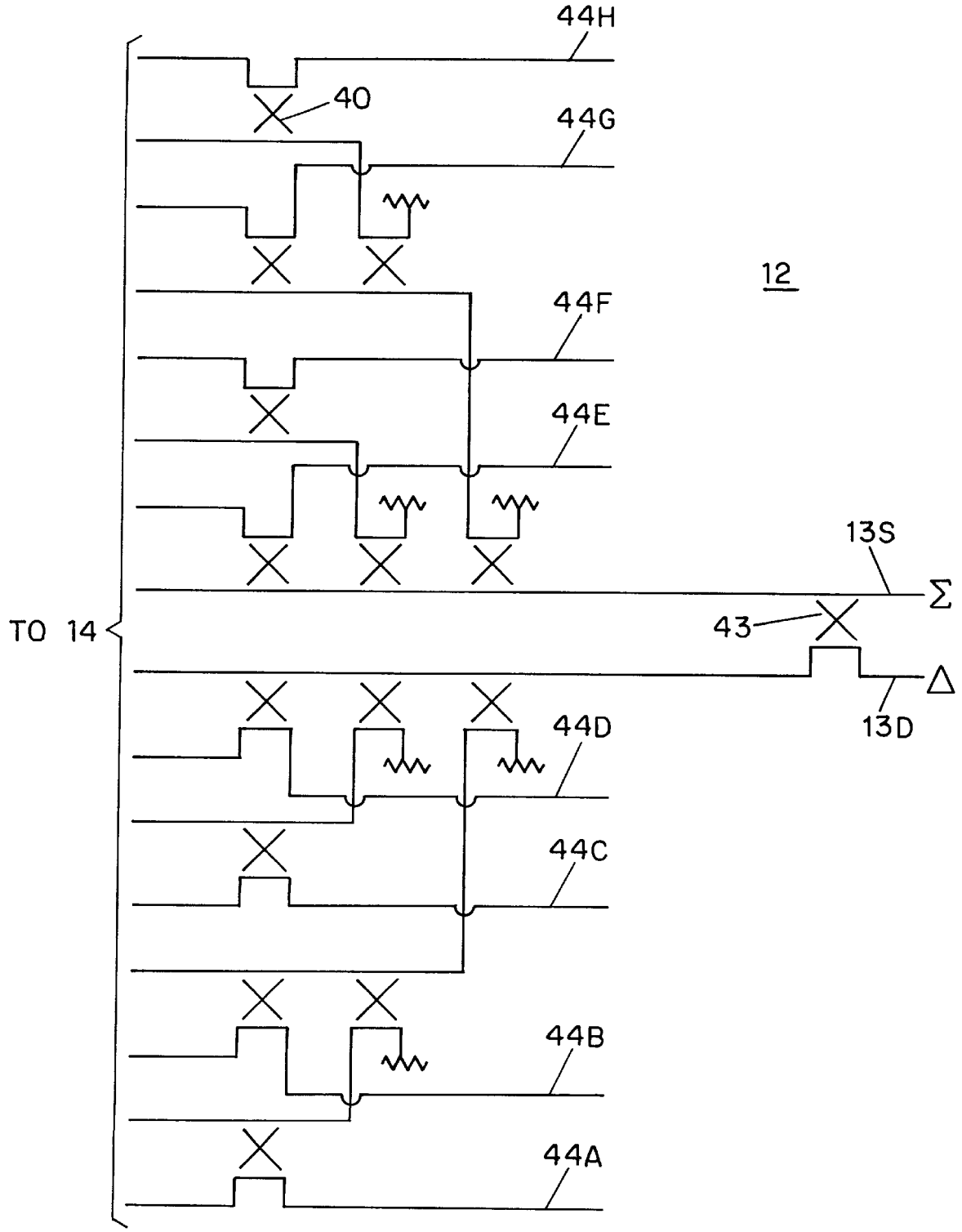

FIG. 5B illustrates a form of primary beam forming network 12 pursuant to the invention. As discussed, the network of FIG. 5A is configured to produce a beam pattern comprising sum and difference beam patterns having desired characteristics. Without changing that capability, the FIG. 5B network 12 has been modified from the FIG. 5A configuration in order to provide access, via signal paths 44A–44H, to signals from the ancillary ports of selected ones of the fourteen four-port couplers which were resistively terminated in the FIG. 5A configuration. Such resistive terminations are removed in FIG. 5B. Thus, in FIG. 5B, signal paths 44A–44H provide signals from ancillary ports of eight selected directional couplers, such as coupler 40, thereby making available eight received signals which are not used in producing the primary sum and difference signals. The remaining four ancillary ports remain resistively terminated in FIG. 5B, however, ancillary signals from these ports could also or alternatively be utilized in other embodiments. To the left in FIG. 5B are 16 signal paths which in FIG. 1 are shown coupled from network 12 to array antenna 14. To the right in FIG. 5B are sum and difference signal paths 13S and 13D which are also shown to the left and right of primary beam forming network 12 in FIG. 1.

Figure 6:
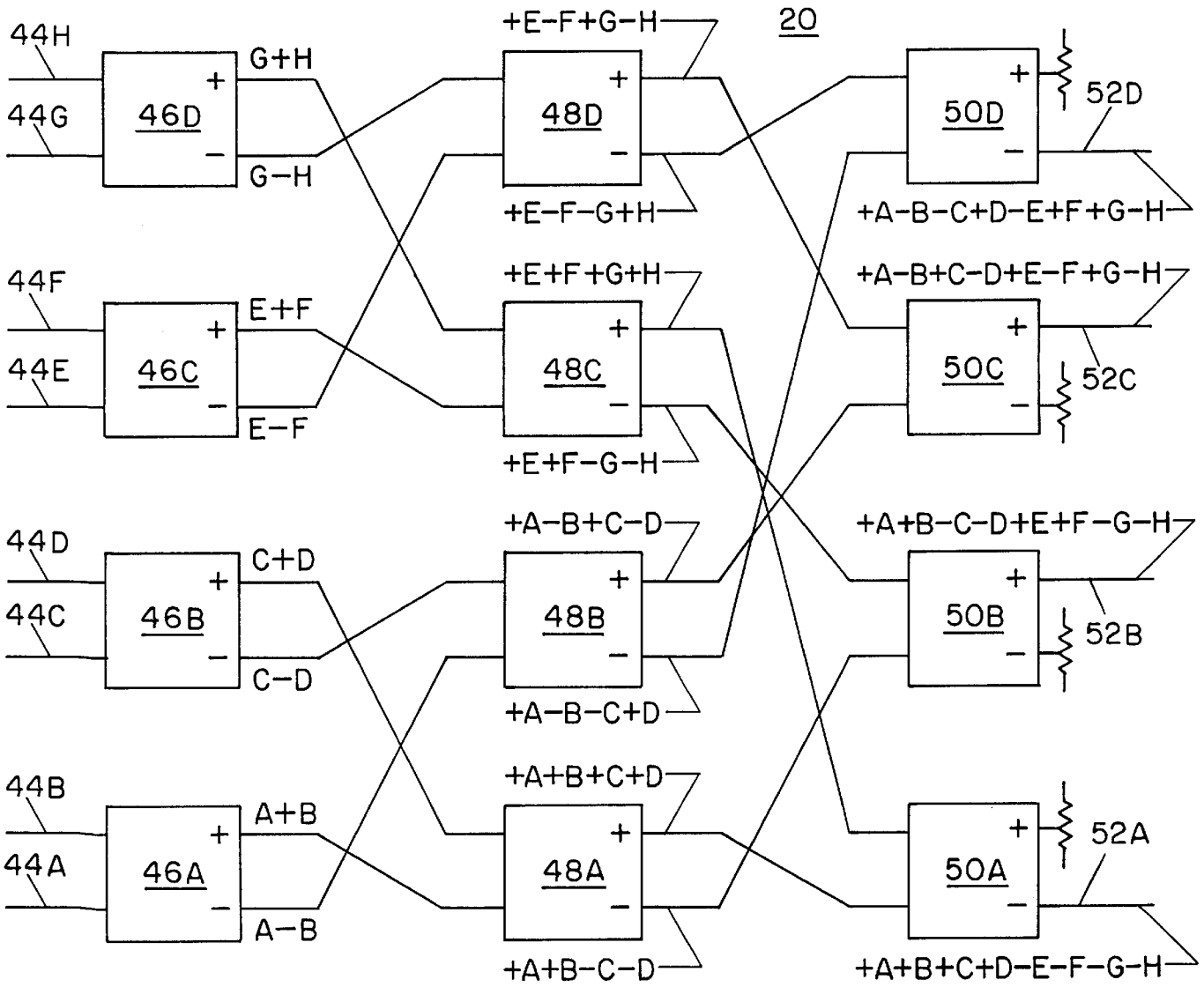
FIG. 6 provides additional detail for an embodiment of the auxiliary beam forming network of FIG. 1.

Referring now to FIG. 6, there is illustrated an embodiment of auxiliary beam forming network 20 of FIG. 1. Network 20 of FIG. 6 includes three levels of four-port directional couplers (e.g., 3 dB branchline type couplers configured to split signals into two equal portions). At the first level, couplers 46A–46D are responsive to received signal inputs from signal paths 44A–44H, representing signals from ancillary ports of primary beam forming network 12. Without describing all of the signal paths, with reference to FIG. 6 it will be seen that if signals provided in signal paths 44A–44H are considered signals A–H, respectively, first level coupler 46A receives inputs A and B and provides outputs A−B and A+B. Coupler 48A, of the second level of couplers 48A–48D, then receives inputs A+B and C+D (the latter from hybrid 46B, as illustrated). Resulting outputs of coupler 48A are +A+B−C−D and +A+B+C+D. Similarly, hybrid 50A, of the third level of hybrids 50A–50D, receives inputs from hybrids 48A and 48C, to provide an output +A+B+C+D−E−F−G−H at signal path 52A. As shown, the other output of coupler 50A (which could be used as another auxiliary beam signal in a different embodiment of the invention) is resistively dissipated. Correspondingly, an output +A+B−C−D+E+F−G−H is provided at output path 52B of hybrid 50B, an output +A−B+C−D+E−F+G−H is provided at signal path 52C, and an output +A−B−C+D−E+F+G−H is provided at signal path 52D. Signals at signal paths 52A–52D are termed "auxiliary signals" and thus represent combinations of signal components received via the array antenna 14 and combined in a manner so as to represent signals received via four auxiliary beam patterns, each of which is different from each other and from the primary sum and difference patterns. These four auxiliary beams are represented by the beam patterns of FIGS. 4A–4D, as previously referred to. As noted, if desired, the respective resistively terminated outputs of couplers 50A–50D could also or alternatively be utilized, and are representative of auxiliary signals received via four additional auxiliary beam patterns.

Thus, the auxiliary beams of FIGS. 4A–4D are formed by tapping into the primary beam forming network 12 at ancillary ports (ports which had been terminated in FIG. 5A) of the couplers that feed the 16 radiating elements of the array antenna 14. By combining these ancillary port signals from the 16 radiating elements in network 20, which comprises an orthogonal matrix combining signals via Walsh type function polarities, a set of eight orthogonal auxiliary beams are formed. The outputs representing only four of these beams, as appearing at paths 52A–52D are used in the present embodiment of the adaptive nulling system, the outputs for the other four auxiliary beams being resistively terminated at couplers 50A–50D as shown in FIG. 5B. Use of auxiliary signals for only four of the beams reduces the number of LMS control loops to be implemented as described below, while still providing a high level of performance. In other embodiments all or other combinations of the available auxiliary beams may be selected for use in the nulling system.

The four auxiliary beams that are used were selected on the basis of coverage of the region near the main beam of the sum pattern. As shown in the calculated beam patterns of FIGS. 4A–4D, the highest lobes of the selected auxiliary beam patterns fall at angular regions adjacent to the center of the sum beam. The peak levels of the four auxiliary beam patterns are illustrated independent of an approximately 9 dB split loss imposed by the 3 dB couplers of the auxiliary beam forming network 20. Since the auxiliary beam signals will be amplified for use in the LMS control loops, actual levels are not important in considering operation of the invention. It will be seen that each of the auxiliary beam patterns in FIGS. 4A–4D has a spatial notch at beam center, which is effective to reduce nulling effects at the center of the sum beam, while still permitting the system to implement nulling of jammer signals within the main beam portions of the sum and difference beam patterns.

With reference to FIG. 1, the four auxiliary signals available from couplers 50A–50D of auxiliary beam forming network 20 are coupled, via signal paths 52A–52D to signal divider unit 28. Divider unit 28 includes a network effective to divide each input signal, so that a portion of each of the four auxiliary signals from signal paths 52A–52D is provided to each of units 22, 24S and 24D.

Figure 7:
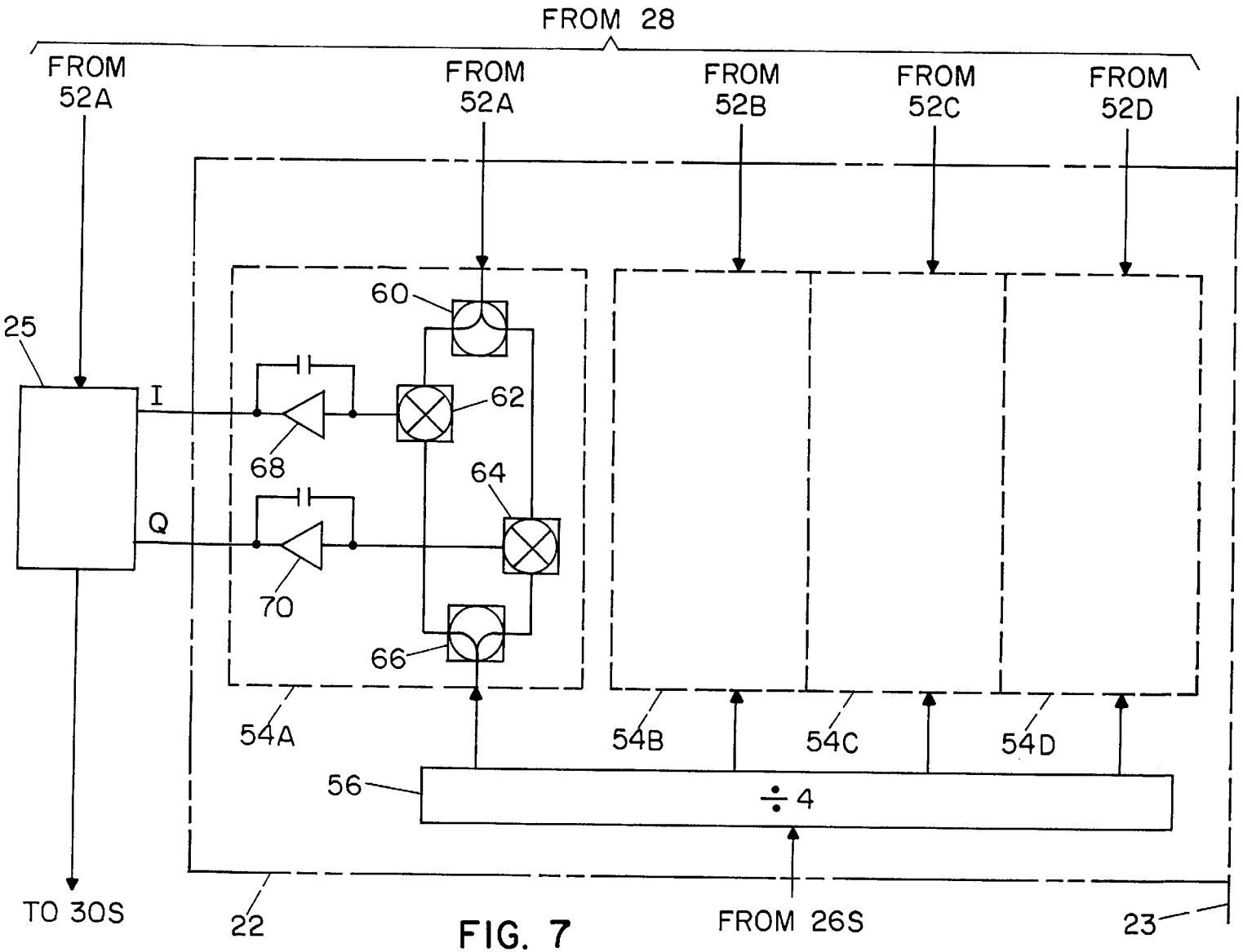
FIG. 7 provides additional detail for an embodiment of the controller of FIG. 1 and an associated least mean square control loop.

FIG. 7 provides additional detail as to an embodiment of controller 22 of FIG. 1. Controller 22 provides similar processing for each of the four ancillary signals and processing for one ancillary signal will be representatively addressed. As represented in FIG. 7, auxiliary signals from paths 52A–52D are provided to controller 22 via the divider unit 28. Controller 22 operates to provide control signals to weighting unit 24S, which include four complex weighting devices (one of which is identified as device 25 in FIGS. 1 and 7).

With reference to FIGS. 1 and 7, it will be seen that dashed line 23 effectively bisects controller 22 so sum signal adaptive processing is implemented to the left of line 23 and difference signal adaptive processing is implemented to the right. For purposes of description, the right half of processor 22, which can be considered to have a mirror image relationship to the portion of processor shown in FIG. 7, is omitted from FIG. 7. In the embodiment illustrated in FIG. 7, controller 22 effectively comprises four independent loop controllers 54A–54D operating in parallel to each provide control signals responsive to one of the auxiliary signals provided via signal paths 52A–52D and to adapted received signals provided via coupler 26S of FIG. 1. Each of the loop controllers 54A–54D is thus a component in an adaptive control loop providing adaptive signals via control of a respective one of the four complex weighting devices of weighting unit 24S of FIG. 1 (of which weighting device 25 of FIG. 7 is one representative device).

The representative individual control loop including loop controller 54A and complex weighting device 25 will be considered in greater detail with reference to FIG. 7. This loop comprises a least mean square (LMS) type control loop for providing weighted auxiliary signals for adaptive nulling of the received sum signal. As shown, loop controller 54A is responsive to an auxiliary signal representative of signals received via the FIG. 4A auxiliary beam pattern as provided via signal path 52A. Loop controller 54A is also responsive on a feedback basis to the adapted received sum signal as it exists after adaptive nulling modification, as sampled from the output sum signal path and fed back by directional coupler 26S. As shown in FIG. 7, the sample of the adapted sum signal fed back via coupler 26S is provided to signal divider 56, which provides a portion to each of the four loop controllers 54A–54D. It will be appreciated that signal amplification may be provided at various points as appropriate and is not specifically addressed in the context of the simplified circuit diagrams as provided. As indicated in FIG. 7, complex weighting device 25 of unit 24S also receives a portion of the auxiliary signal representative of signals received via the FIG. 4A auxiliary beam pattern as provided via signal path 52A from signal divider network 28.

Figure 4A:
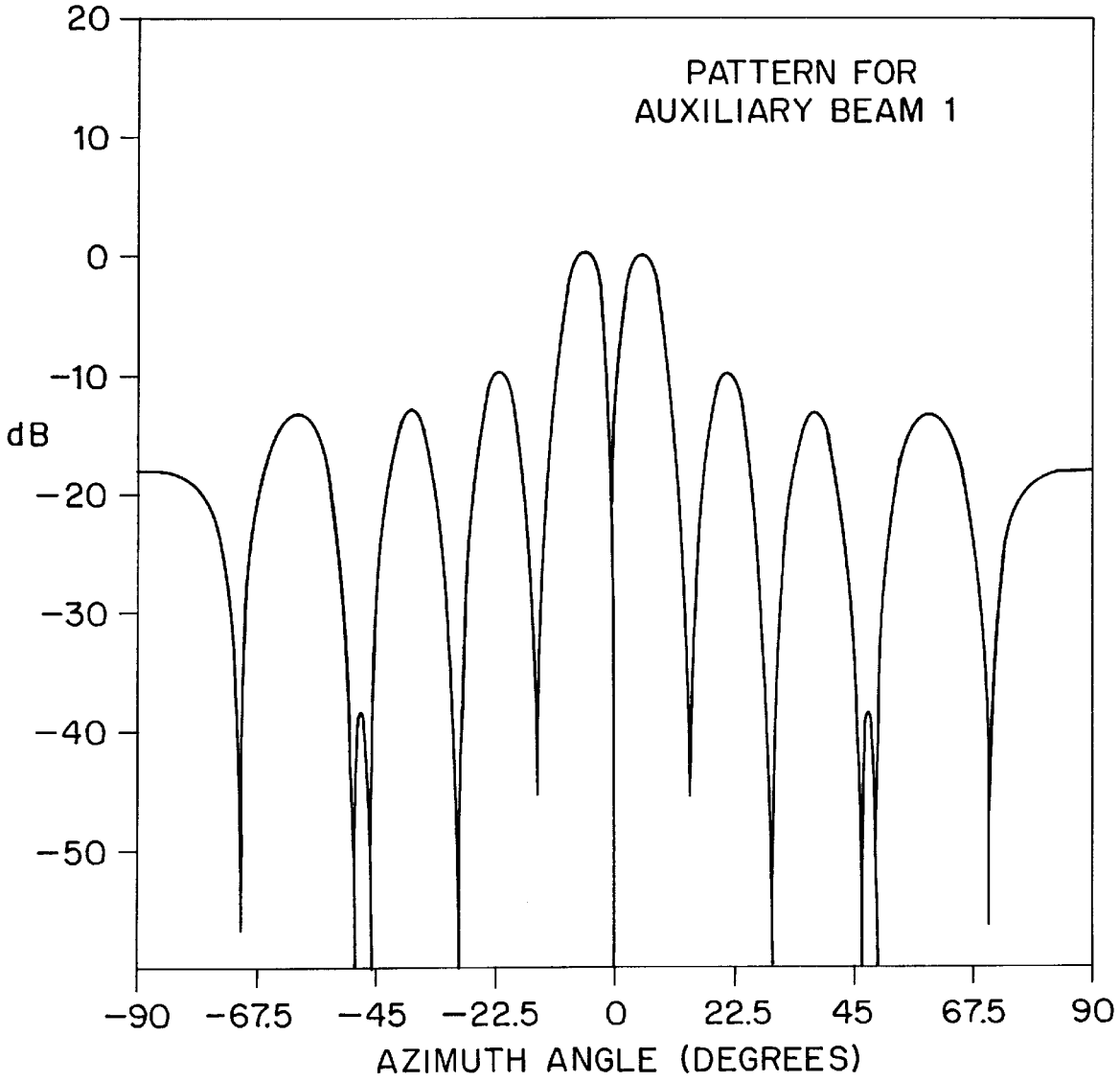
FIGS. 4A, 4B, 4C and 4D are beam patterns for four different auxiliary beams provided by the auxiliary beam forming network of FIG. 1.

In operation, the 54A/25 LMS control loop, as described with reference to FIG. 7, receives via signal path 52A a unique auxiliary signal as provided by the auxiliary beam forming network 20 and representative of signals received via the auxiliary beam pattern of FIG. 4A. Loop controller 54A of this LMS control loop is responsive to the auxiliary signal from path 52A and the sample of the adapted sum signal from coupler 26S to produce I and Q control signals. In the illustrated embodiment, loop controller 54A includes an I/Q hybrid 60 providing an in-phase portion of the auxiliary signal to phase detector 62 and a corresponding quadrature phase portion of the auxiliary signal to phase detector 64. Portions of the feedback signal from coupler 26S via divider 56, are provided to the phase detectors 62 and 64 by signal divider 66. The in-phase portion of the auxiliary signal is thus utilized with the feedback signal portion by phase detector 62 to generate an I control signal which is fed to complex weighting device 25, with additional gain provided by integrator 68. Correspondingly, the quadrature phase portion of the auxiliary signal is utilized with the feedback portion of the adapted sum signal by phase detector 64 to generate a Q control signal which is fed to complex weighting device 25, via integrator 70. The I and Q control signals provided to the complex weighting device 25 are utilized to control adjustment of both amplitude and phase of the auxiliary signal input to the weighting device from signal path 52A. On an LMS basis, adjustment of the amplitude and phase of the auxiliary signal produces a "weighted" auxiliary signal which, when combined with reverse polarity into the received sum signal, will add destructively to a jamming signal (i.e., add a negative replica of the jamming signal to cause cancellation by signal subtraction).

Replication of the jamming or other interference signal is produced by automatic adjustment of the weighting device so as to modify the signal from the auxiliary beam in an LMS manner that minimizes the presence of the jamming signal in the adapted sum signal, which result is indicative that a replica of the jamming signal has been negatively added into the sum channel to achieve cancellation. Thus, the weighted auxiliary signal at the output of weighting device 25 is provided (as shown in FIG. 1) to directional coupler 34S of signal combiner 30S and coupler 34S is effective to couple the weighted auxiliary signal into the output signal path 36S, wherein it destructively adds to provide nulling of a jamming signal. As seen in FIG. 1, the adapted sum signal provided on a feedback basis by coupler 26S is selected at a point after the weighted auxiliary signal has been combined with the received sum signal so as to enable the LMS processing to optimize jamming nulling as provided by the LMS control loop. LMS control loop design and operation are further described in U.S. Pat. No. 4,584,583, titled "LMS Adaptive Loop Module", and related theory and design considerations are addressed in U.S. Pat. No. 4,280,128 titled "Adaptive Steerable Null Antenna Processor", both of which are hereby incorporated by reference. It is noted that consistent with LMS loop design practices, phase detectors such as devices 62 and 64 may be replaced by signal mixers or other suitable devices in other embodiments.

Figure 4B:
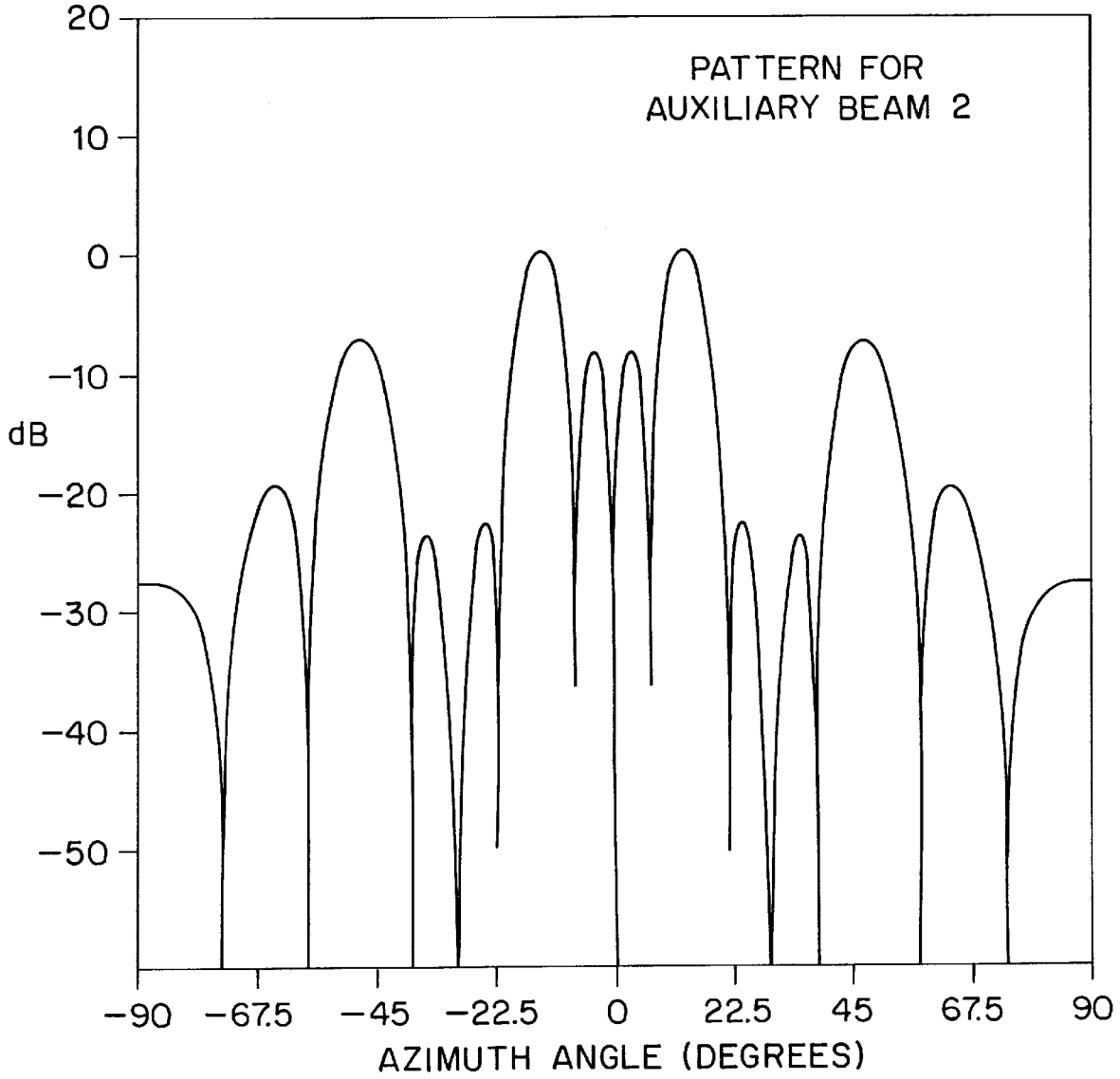
Figure 4C:
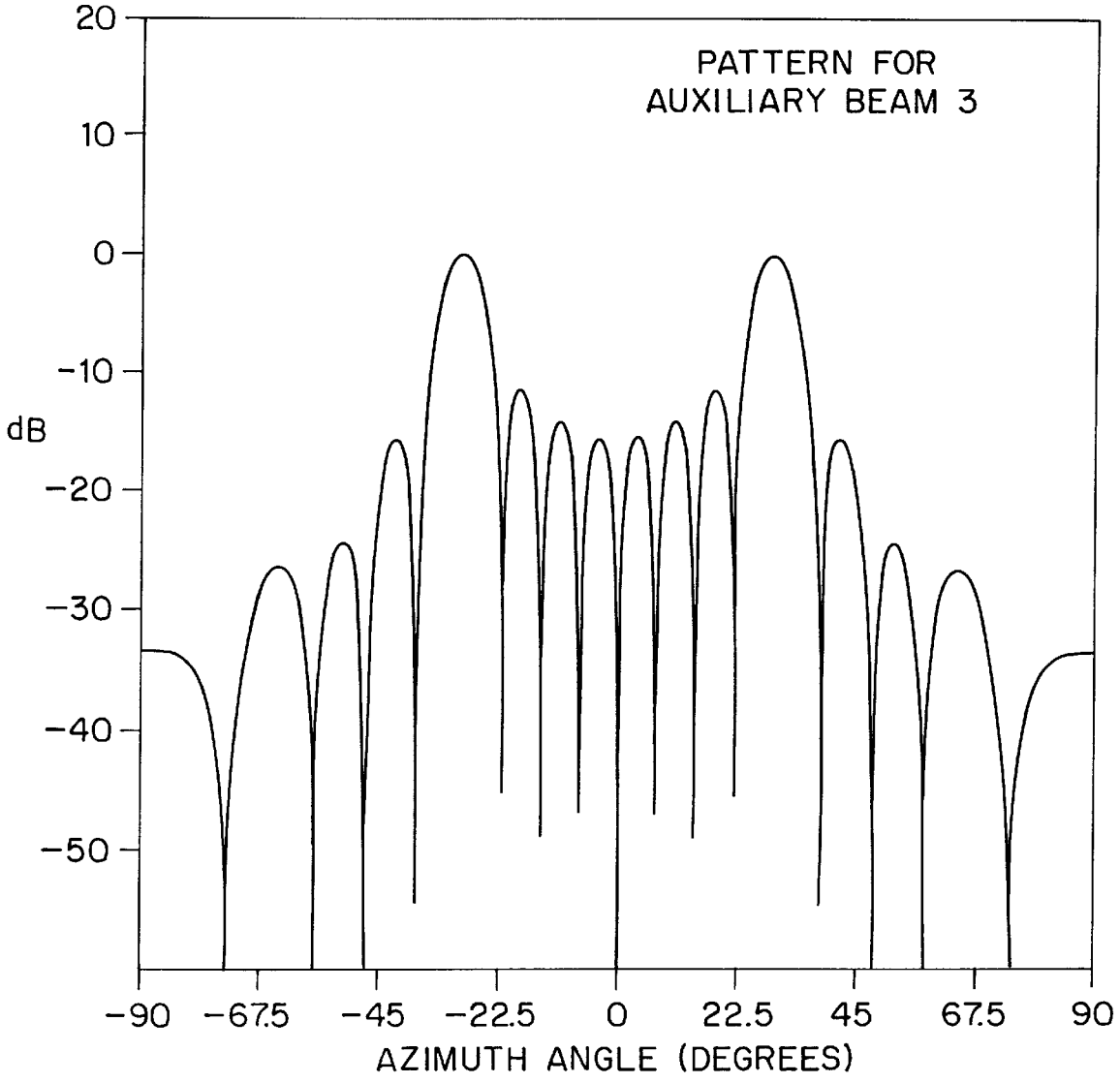
Figure 4D:
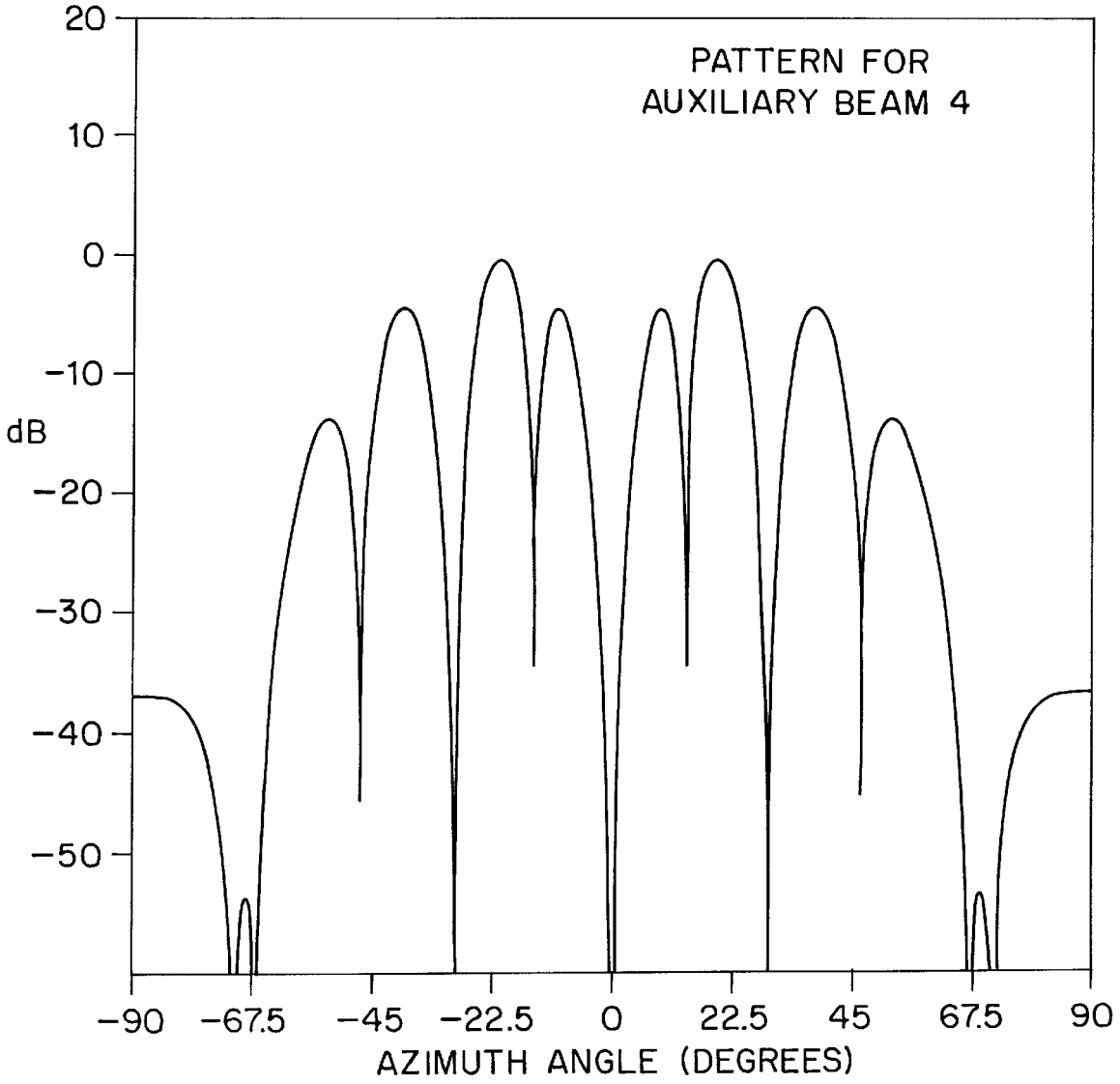
Figure 8A:
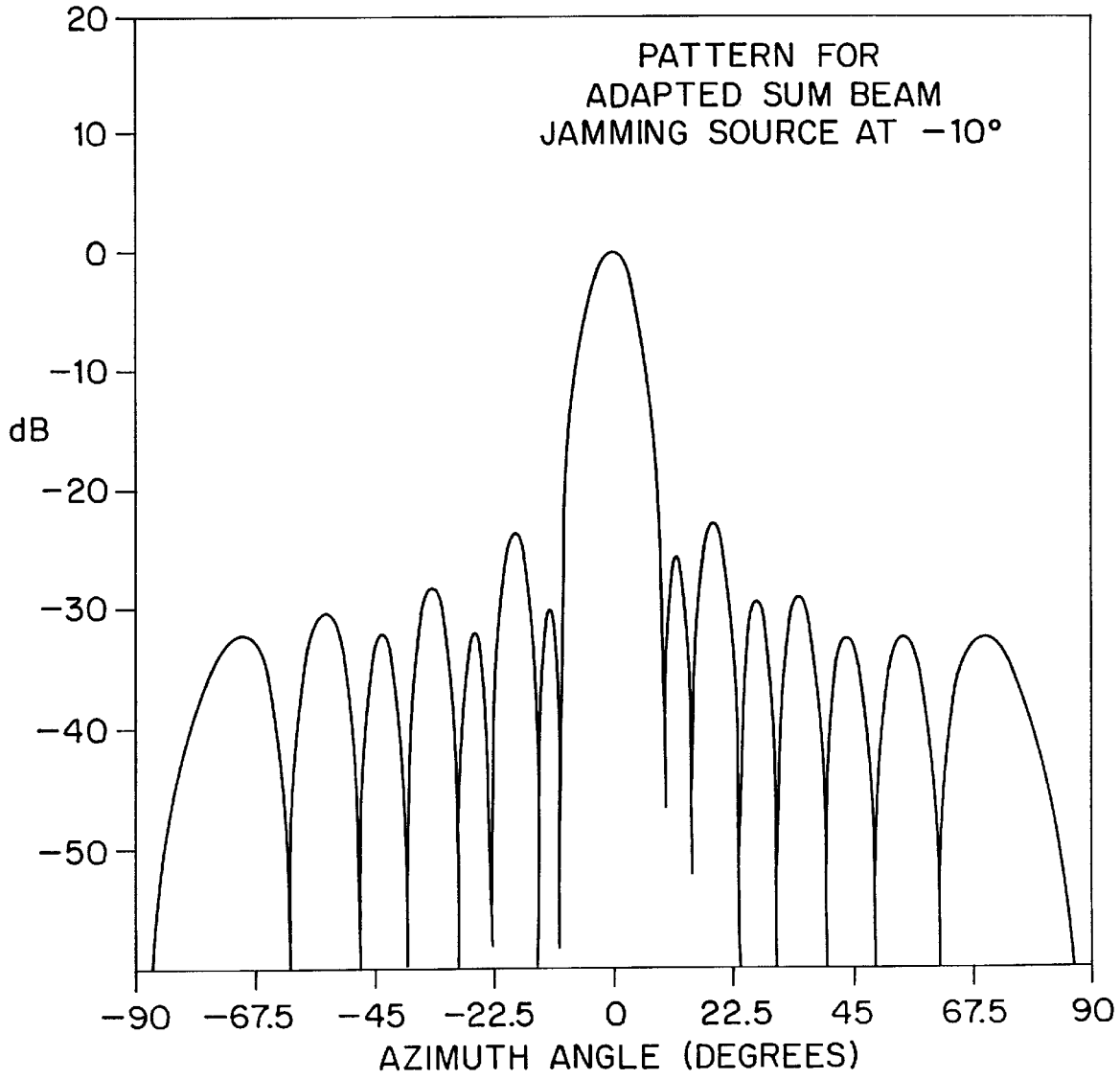
FIGS. 8A, 8B, 8C and 8D are adapted sum beam patterns illustrating effects of adaptive nulling for interference signals with respective azimuth arrival angles of −10, −8, −6 and −4 degrees into the sum beam pattern of FIG. 2.
Figure 8B:
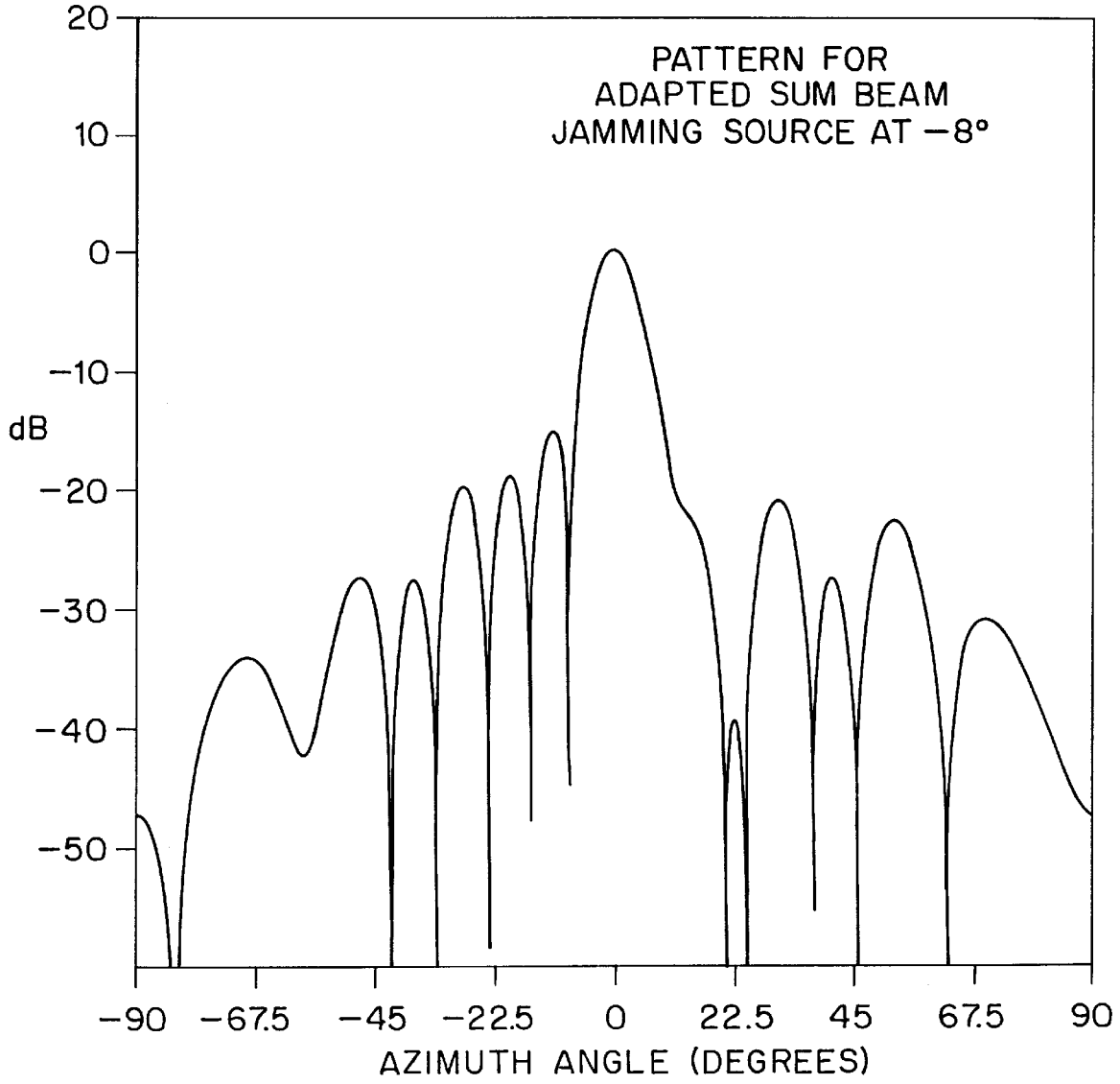
Figure 8C:
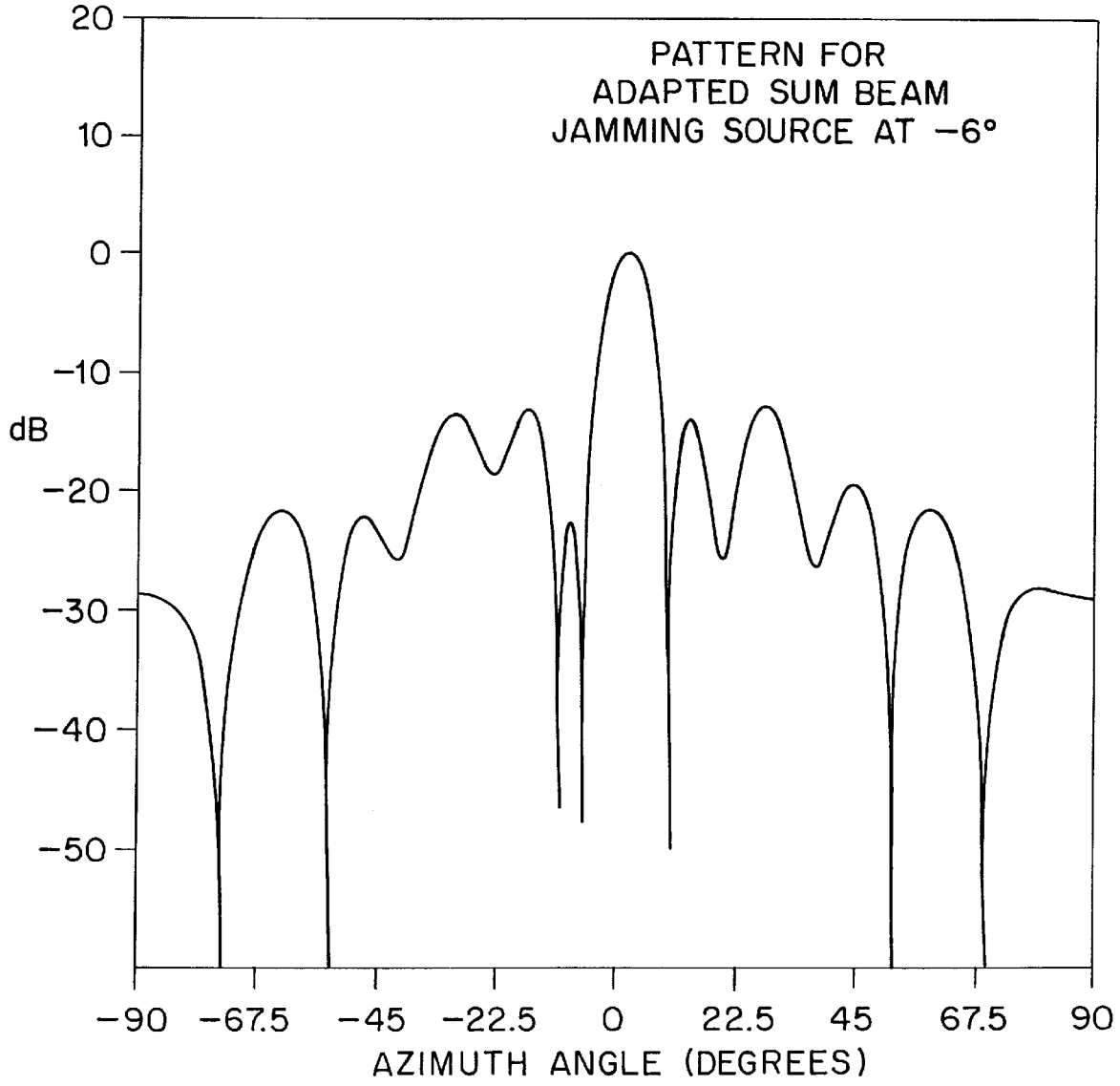
Figure 8D:
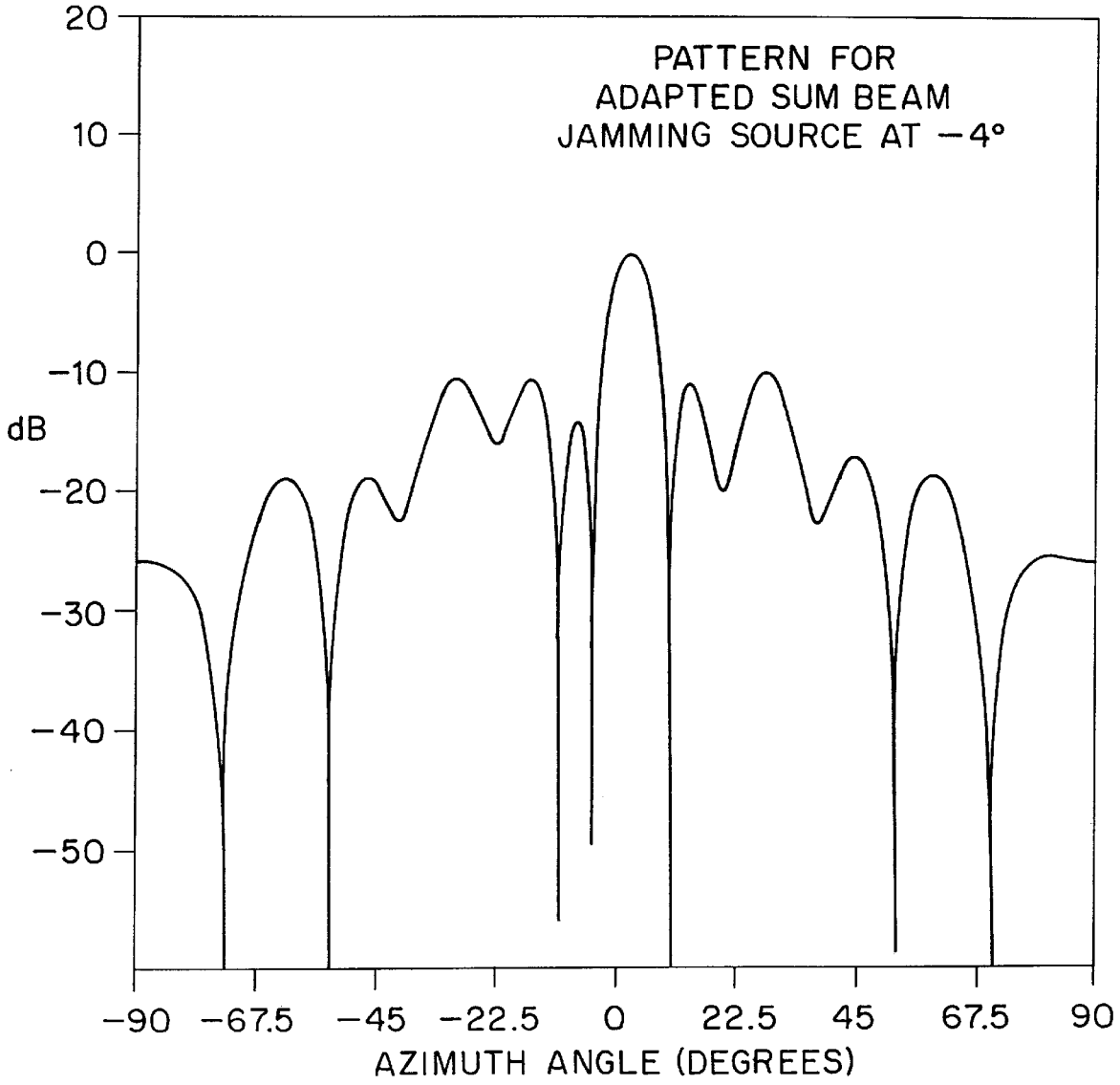
Figure 9A:
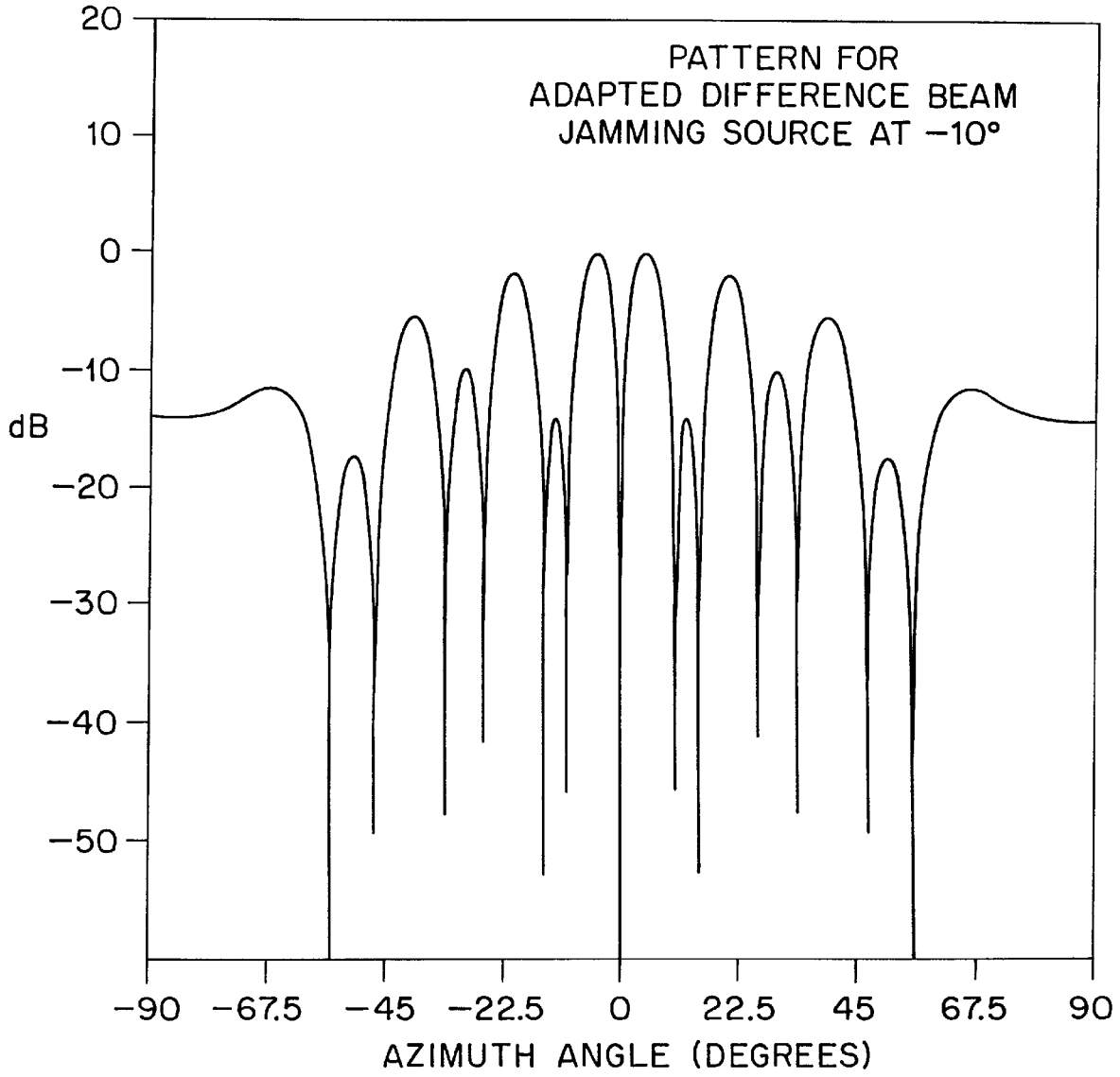
FIGS. 9A, 9B, 9C and 9D are adapted difference beam patterns illustrating effects of adaptive nulling for interference signals with respective azimuth arrival angles of −10, −8, −6 and −4 degrees into the difference beam pattern of FIG. 3.
Figure 9B:
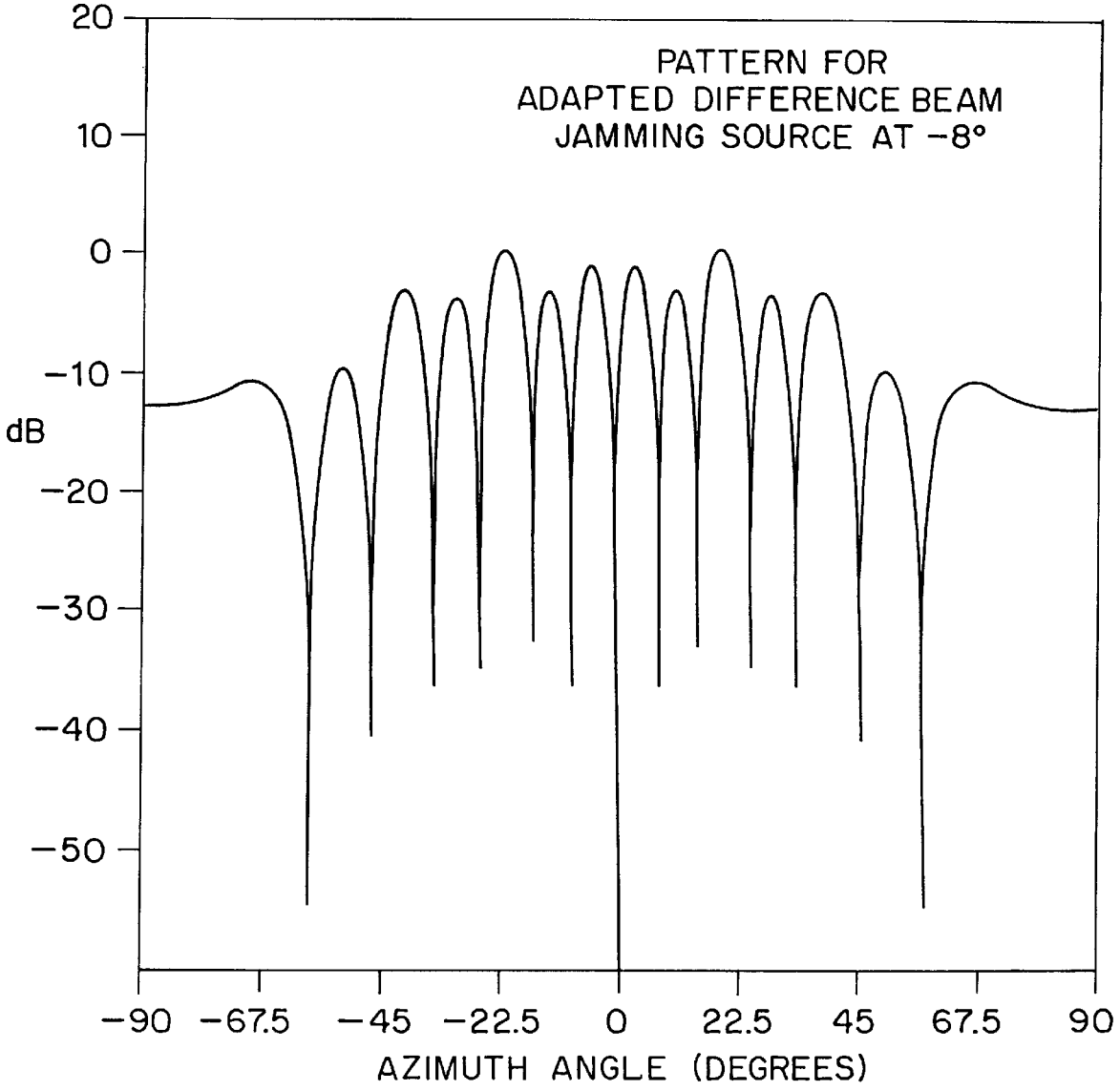
Figure 9C:
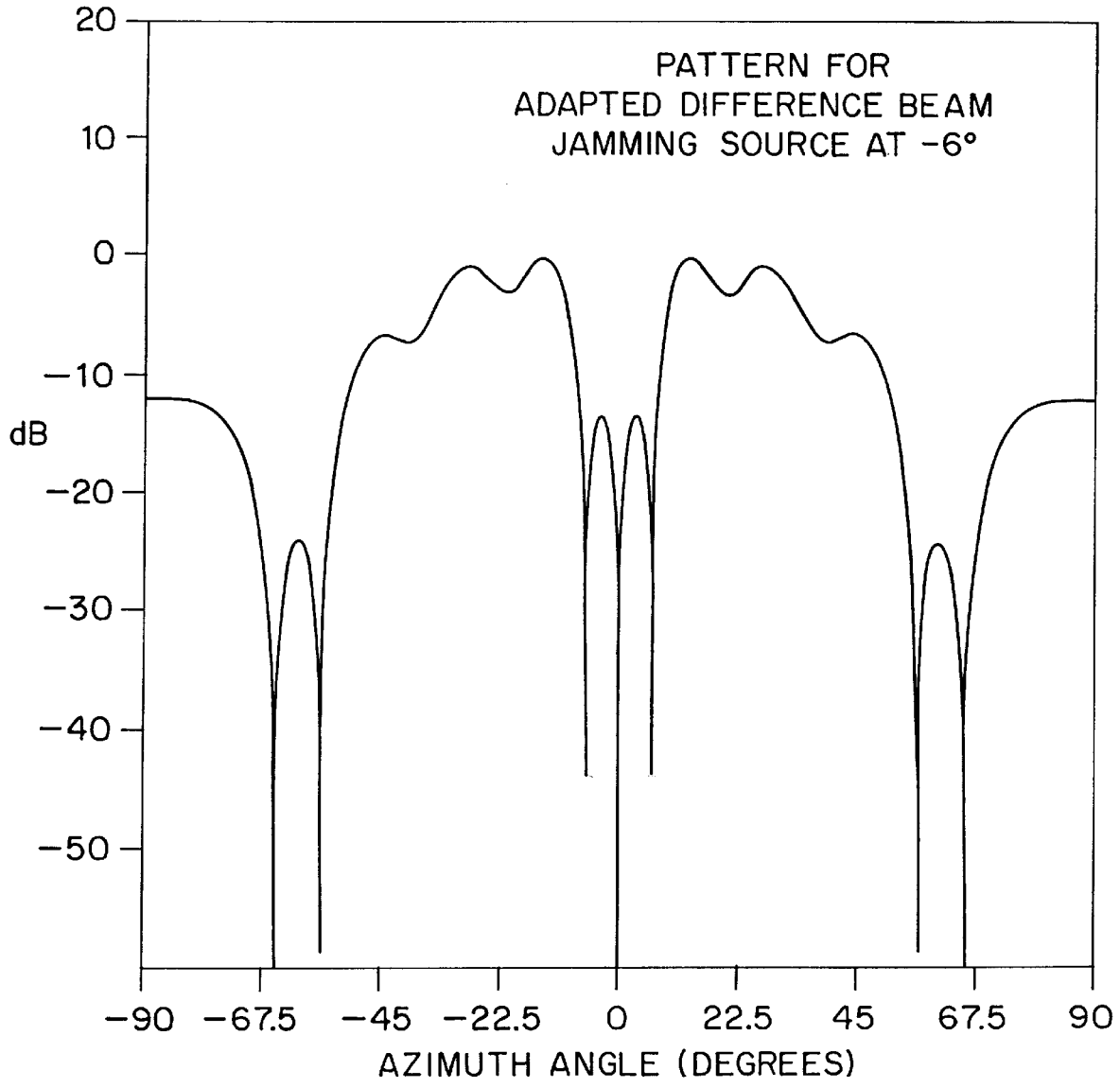
Figure 9D:
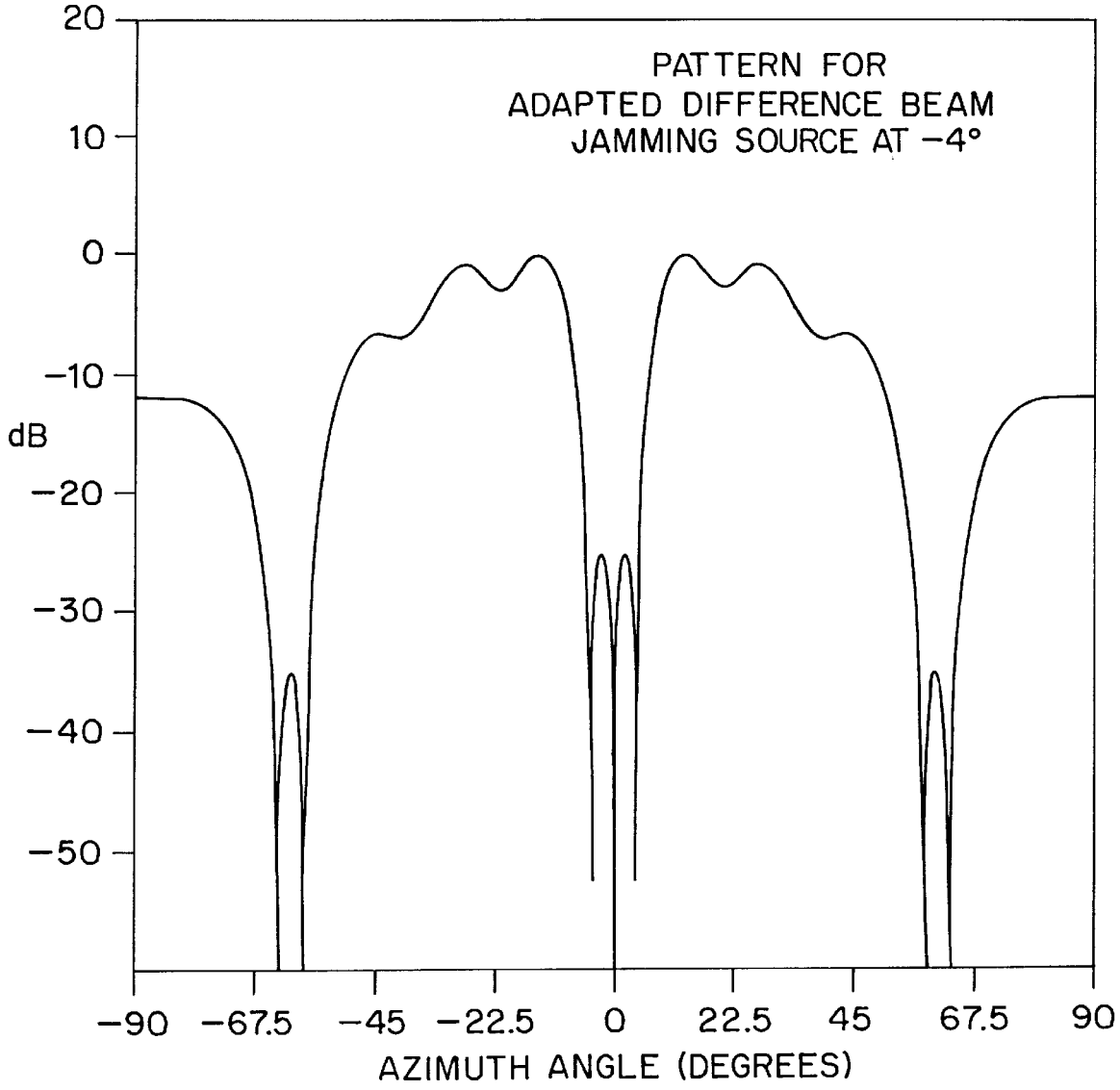

While attention has been specifically directed to the 54A/25 LMS control loop of FIG. 7, it will be appreciated that the portion of controller 22 to the left of dashed line 23 includes three additional loop controllers 54B–54D arranged to provide corresponding LMS control loop operation in conjunction with the three remaining complex weighting devices of unit 24S as shown in FIG. 1, in order to utilize auxiliary signals provided by auxiliary beam forming network 20 from signals received via the beam patterns of FIGS. 4B–4D. Calculated patterns illustrating results of adaptive nulling of the sum beam by use of the FIG. 1 system are provided in FIGS. 8A–8D. The relevant arrival angles for jamming or interference for the examples provided in FIGS. 8A–8D are respectively −10, −8, −6 and −4 degrees relative to antenna boresight. Thus, FIG. 8A is the calculated adapted sum beam pattern for null formation on a jamming source with an arrival angle of −10 degrees. The basic nature of the sum pattern remains in FIG. 8A. The peak of the adapted sum pattern is 12.5 dB, which is increased from the unadapted sum pattern of FIG. 2, basically due to electronic gain provided in the auxiliary beam paths. The adapted patterns as calculated for interference signals arriving at angles of −8, −6 and −4 degrees are respectively shown in FIGS. 8B–8D. In these figures the gain at pattern peak is normalized to 0 dB for purposes of presentation.

As discussed, controller 22 includes, to the right of dashed line 23, a mirror image embodiment of the configuration shown in FIG. 7 and described above. Thus, complex weighting device 25' of weighting unit 24D is responsive to control signals from a difference channel loop controller corresponding to the sum channel controller 54A (shown to the left of line 23). Weighting device 25' is responsive to control signals derived in response to the same auxiliary signals provided via signal path 52A, but is also responsive to an adapted signal fed back from the adapted difference signal on path 36D via directional coupler 26D. The right side portion of controller 22 is also responsive to auxiliary signals provided via signal paths 52B–52D from auxiliary beam forming network 20 (in combination with the adapted difference signal fed back by coupler 26D) to provide control signals to the remaining three complex weighting devices of unit 24D. The resulting weighted auxiliary signals are combined and coupled into the difference signal output path 36D, via signal combiner 30D, to provide an adapted difference signal which has been subjected to adaptive nulling by destructive addition of the weighted auxiliary signals to a jamming signal present with the received difference signal. As with the sum signal, a sample of the adapted difference signal is fed back, via coupler 26D for use in the difference side LMS control loops.

Corresponding to FIGS. 8A–8D, FIGS. 9A–9D are the calculated adaptive beam patterns illustrative of the results of providing nulling for jamming signals arriving into the difference beam (shown in FIG. 3) at respective angles of −10, −8, −6 and −4 degrees off boresight. It will be understood that these specific angles were selected by way of example and results comparable to those illustrated in FIGS. 8A–8D and 9A–9D will be obtained for jamming or other interference entering the main beam portions of the sum or difference channels over a wide range of arrival angles on either side of antenna boresight. In addition, although the analysis and system architecture were particularly structured to process main beam interference, the approach is also effective for interference arriving within the sum and difference sidelobe regions.

Two features of systems utilizing the invention should be specifically addressed. IFF and many radar signals comprise high power pulses which are widely spaced, so that average power is relatively low. Jamming and other interference signals may have a continuous wave (CW) or other relatively higher average power format. The controller 22 of FIG. 1, as described, is particularly effective in providing control signals responsive to the presence of relatively higher average power signals, so as to result in reduction in amplitude of such signals in an adapted received signal. Also since the auxiliary signals are provided from signals received via the same radiating elements as the primary received signals, the auxiliary signals will have been subjected to the same relative phase adjustments for beam steering as the primary received signals. As a result, the auxiliary beams will also be steered so as to track steering of the primary beam pattern. Auxiliary signals provided by the auxiliary beam forming network will thus be produced via auxiliary beams steered in azimuth so as to track steering of the primary beam pattern.

With reference to FIG. 1, it will now be appreciated that in operation of the nulling system sum signal transmission is accomplished by signals provided to the Σ port (shown at the bottom in FIG. 1) and difference signal transmission results from signals provided to the Δ port. On reception, adapted received signals in the form of adapted sum signals and adapted difference signals are made available at the respective Σ' and Δ' ports. As previously noted, the system as illustrated in simplified form in FIG. 1 does not include arrangements and additional elements as appropriate to isolate reception and transmission signal paths (e.g., to protect the adaptive processor components from damage by high levels of transmitted power). Appropriate devices and configurations to meet these and other objectives suitable for practical operation can be provided by skilled persons using established techniques, devices and circuit arrangements. In this context, with the above description of the primary and secondary beam forming networks 12 and 20 it will be appreciated that in other embodiments the two networks 12 and 20 may be combined into a unitary beam forming unit 12/20 (as represented by the dashed lines joining these networks in FIG. 1) which provides the described functions of these units. On a different matter, in the embodiment illustrated and described there are provided eight separate LMS control loops; four to provide adaptive nulling for each of the sum and difference signals. In other arrangements the number of separate LMS control loops and related circuit components can be significantly reduced by use of time sharing or multiplexing arrangements to permit one control loop to be used to provide control signals responsive to a plurality of auxiliary signals. One reason why time sharing or multiplexing is practical results from the fact that changes in jamming or interference effects typically occur relatively slowly relative to basic operating parameters. Multiplexing and related techniques are described in U.S. Pat. No. 4,177,464, titled "Multiplexing of Multiple Loop Sidelobe Cancellers", which is hereby incorporated by reference.

While there have been described the currently preferred embodiments of the invention, those skilled in the art will recognize that other and further modifications may be made without departing from the invention and it is intended to claim all modifications and variations as fall within the scope of the invention.

I claim:

1. An adaptive nulling system for use with an array antenna, comprising:

a primary beam forming network to couple signals to and from an array of radiating elements to produce a primary received signal via a primary beam pattern, said beam forming network including ancillary ports providing signals not used in producing said primary received signal;

an auxiliary beam forming network, responsive to signals from said ancillary ports, to produce auxiliary signals received via a number of auxiliary beams;

a controller, responsive to said auxiliary signals and to an adapted received signal, to provide control signals;

a weighting unit, responsive to said control signals and to said auxiliary signals, to provide weighted auxiliary signals; and a signal combiner arranged to combine said weighted auxiliary signals with said primary received signal to provide said adapted received signal.

2. An adaptive nulling system as in claim 1, wherein said auxiliary beam forming network is arranged to produce a plurality of auxiliary signals representing signals received via a like plurality of auxiliary beams.

3. An adaptive nulling system as in claim 1, wherein said weighting unit is arranged to provide a weighted auxiliary signal representing a replica of an interfering signal and said signal combiner is arranged to combine said weighted auxiliary signal in reverse polarity with said primary received signal, to provide an adapted received signal characterized by reduction in amplitude of said interfering signal.

4. An adaptive nulling system as in claim 3, wherein said primary received signal is a pulsed signal of relatively low average power, said interfering signal is of relatively higher average power, and said controller is arranged to provide control signals responsive to the presence of relatively higher average power signals in said adapted received signal.

5. An adaptive nulling system as in claim 1, additionally comprising a steering unit to control the relative phase of signals coupled to and from said radiating elements to steer said primary beam pattern in azimuth, and wherein said auxiliary beam forming network produces said auxiliary signals via auxiliary beams steered in azimuth to track steering of said primary beam pattern.

6. An adaptive nulling system as in claim 1, wherein said primary beam forming network includes coupling devices in the form of four-port directional couplers each having an ancillary port, with selected ancillary ports coupled to said auxiliary beam forming network and any remaining ancillary ports resistively terminated.

7. An adaptive nulling system as in claim 1, wherein said weighting unit includes a plurality of weighting devices, each responsive to control signals and an auxiliary signal, to provide a different weighted auxiliary signal for each of a plurality of auxiliary signals provided by the auxiliary beam forming network.

8. An adaptive nulling system as in claim 1, wherein said signal combiner includes a summer to combine weighted auxiliary signals and a coupler to combine the combined weighted auxiliary signals, from the summer, with the primary received signal to provide the adapted received signal utilized by the controller.

9. An adaptive nulling system as in claim 1, wherein said auxiliary beam forming network produces at least one auxiliary signal received via at least one auxiliary beam, and said primary and auxiliary beam forming networks are combined into a unitary beam forming unit.

10. An adaptive nulling system for use with an array antenna, comprising:

a primary beam forming network to couple signals to and from an array of radiating elements to produce a primary received signal via a primary beam pattern, said beam forming network including ancillary ports providing signals not used in producing said primary received signal;

an auxiliary beam forming network responsive to signals from said ancillary ports to produce a number of auxiliary signals, each received via a different auxiliary beam;

a controller, responsive to said auxiliary signals and to an adapted received signal, to provide control signals for use with each said auxiliary signal;

a weighting unit, including a weighting device responsive to each said auxiliary signal and to control signals provided for use with such auxiliary signal, to provide said number of weighted auxiliary signals; and a signal combiner arranged to combine said weighted auxiliary signals with said primary received signal to provide said adapted received signal.

11. An adaptive nulling system as in claim 10, wherein said auxiliary beam forming network is arranged to produce four auxiliary signals received via four auxiliary beams, and said weighting unit provides four weighted auxiliary signals which are summed in said signal combiner and combined with the primary received signal to provide said adapted received signal utilized by the controller.

12. An adaptive nulling system as in claim 10, wherein said weighting unit is arranged to provide a weighted auxiliary signal representing a replica of an interfering signal and said signal combiner is arranged to combine said weighted auxiliary signal in reverse polarity with said primary received signal, to provide an adapted received signal characterized by reduction in amplitude of said interfering signal.

13. An adaptive nulling system as in claim 10, wherein said primary beam forming network includes coupling devices in the form of four-port directional couplers each having an ancillary port, with selected ancillary ports coupled to said auxiliary beam forming network and any remaining ancillary ports resistively terminated.

14. An adaptive nulling system as in claim 10, wherein said weighting unit includes a plurality of weighting devices, each responsive to control signals and an auxiliary signal, to provide a different weighted auxiliary signal for each of a plurality of auxiliary signals provided by the auxiliary beam forming network.

15. An adaptive nulling system as in claim 10, wherein said auxiliary beam forming network produces at least one auxiliary signal received via at least one auxiliary beam, and said primary and auxiliary beam forming networks are combined into a unitary beam forming unit.

16. An adaptive nulling system, comprising:

an array of radiating elements;

a primary beam forming network coupled to said radiating elements to produce a primary sum signal and a primary difference signal via a primary beam pattern, said beam forming network including ancillary ports providing signals not used in producing said primary signals;

an auxiliary beam forming network, responsive to signals from said ancillary ports, to produce auxiliary signals received via a number of auxiliary beams;

a controller, responsive to said auxiliary signals and to an adapted sum signal and an adapted difference signal, to provide sum and difference control signals;

a first weighting unit, responsive to said sum control signals and said auxiliary signals, to provide weighted auxiliary signals;

a first signal combiner arranged to combine said weighted auxiliary signals from said first weighting unit with said primary sum signal to provide said adapted sum signal;

a second weighting unit, responsive to said difference control signals and said auxiliary signals, to provide weighted auxiliary signals; and a second signal combiner arranged to combine said weighted auxiliary signals from said second weighting unit with said primary difference signal to provide said adapted difference signal.

17. An adaptive nulling system as in claim 16, wherein said weighting unit is arranged to provide a weighted auxiliary signal representing a replica of an interfering signal and said signal combiner is arranged to combine said weighted auxiliary signal in reverse polarity with said primary received signal, to provide an adapted received signal characterized by reduction in amplitude of said interfering signal.

18. An adaptive nulling system as in claim 17, wherein said primary received signal is a pulsed signal of relatively low average power, said interfering signal is of relatively higher average power, and said controller is arranged to provide control signals responsive to the presence of relatively higher average power signals in said adapted received signal.

19. An adaptive nulling system as in claim 16, additionally comprising a steering unit to control the relative phase of signals coupled to and from said radiating elements to steer said primary beam pattern in azimuth, and wherein said auxiliary beam forming network produces said auxiliary signals via auxiliary beams steered in azimuth to track steering of said primary beam pattern.

20. An adaptive nulling system as in claim 16, wherein each said weighting unit includes a plurality of weighting devices, responsive to control signals and an auxiliary signal, to provide a different weighted auxiliary signal for each of a plurality of auxiliary signals provided by the auxiliary beam forming network.

21. An adaptive nulling system as in claim 16, wherein said auxiliary beam forming network produces at least one auxiliary signal received via at least one auxiliary beam, and said primary and auxilliary beam forming networks are combined into a unitary beam forming unit.

22. In an adaptive nulling system for use with an array antenna, an arrangement to provide auxiliary received signals useful for adaptive nulling processing comprising:

a primary beam forming network to couple signals to and from an array of radiating elements to produce a primary received signal via a primary beam pattern, said beam forming network including ancillary ports providing signals not used in producing said primary received signal; and an auxiliary beam forming network responsive to signals from ancillary ports of said beam forming network to produce auxiliary signals received via a number of auxiliary beams, said auxiliary signals usable for adaptive nulling processing in said adaptive nulling system.

23. An arrangement as in claim 22, wherein said auxiliary beam forming network is arranged to produce a plurality of auxiliary signals representing signals received via a like plurality of auxiliary beams.

24. An arrangement as in claim 22, wherein said primary beam forming network includes coupling devices each having an ancillary port, with selected ancillary ports coupled to said auxiliary beam forming network and any remaining ancillary ports resistively terminated.

25. An arrangement as in claim 24, wherein said coupling devices are four-port directional couplers.

26. An arrangement as in claim 22, wherein said primary beam forming network is arranged to provide a primary beam pattern comprising a sum beam pattern and a difference beam pattern, in order to produce a primary received signal comprising a primary sum signal and a primary difference signal, and wherein said auxiliary beam forming network produces auxiliary signals usable for adaptive nulling processing of both said primary sum signal and said primary difference signal.

27. An adaptive nulling system as in claim 22, wherein said primary and auxiliary beam forming networks are combined into a unitary beam forming unit.

* * * * *